US010143863B2

(12) United States Patent
Provencal

(10) Patent No.: US 10,143,863 B2
(45) Date of Patent: Dec. 4, 2018

(54) COVERALL GARMENT HAVING FIRST SPACED-APART BELT LOOPS

(71) Applicant: Patrice Roger Provencal, Anzac (CA)

(72) Inventor: Patrice Roger Provencal, Anzac (CA)

( * ) Notice: Subject to any disclaimer, the term of this patent is extended or adjusted under 35 U.S.C. 154(b) by 290 days.

(21) Appl. No.: 15/244,686

(22) Filed: Aug. 23, 2016

(65) Prior Publication Data

US 2018/0056097 A1 Mar. 1, 2018

(51) Int. Cl.

| | |
|---|---|
| ***A62B 17/00*** | (2006.01) |
| ***A41D 13/005*** | (2006.01) |
| ***A41D 13/02*** | (2006.01) |
| ***A41D 27/20*** | (2006.01) |
| ***A41F 9/00*** | (2006.01) |
| *A41D 13/01* | (2006.01) |

(Continued)

(52) U.S. Cl.

CPC ..... *A62B 17/006* (2013.01); *A41D 13/0053* (2013.01); *A41D 13/02* (2013.01); *A41D 13/0575* (2013.01); *A41D 27/202* (2013.01); *A41F 9/005* (2013.01); *A41F 9/007* (2013.01); *A41D 13/01* (2013.01); *A41D 13/0537* (2013.01); *A41D 13/065* (2013.01); *A41D 13/08* (2013.01); *A41D 27/201* (2013.01); *A41D 31/0027* (2013.01); *A41D 31/0038* (2013.01); *A41D 2300/32* (2013.01); *A41D 2300/324* (2013.01); *A41D 2600/20* (2013.01)

(58) Field of Classification Search

CPC ..... A41D 13/0053; A41D 13/02; A41D 13/0575; A41D 13/05066; A41D 13/015; A41D 13/11; A41F 9/005; A41F 9/007; A62B 17/06

USPC ..... 2/227, 228, 69, 79, 455, 466, 23, 22, 24

See application file for complete search history.

(56) References Cited

U.S. PATENT DOCUMENTS 1,242,777 A 10/1917 Danielson
1,951,098 A * 3/1934 Mann ..... A41F 9/007 2/237

(Continued)

FOREIGN PATENT DOCUMENTS

| | | |
|---|---|---|
| CA | 2510827 | 12/2006 |
| CA | 2860679 | 12/2017 |
| WO | 2004077975 | 9/2004 |

OTHER PUBLICATIONS

HOEY, Restriction Requirement for U.S. Appl. No. 14/854,986, dated Nov. 3, 2017.

(Continued)

*Primary Examiner* — Gloria Hale

(57) ABSTRACT

Apparatus includes a coverall garment having a waist section, and is configured to be worn by a range of users, in which users each respectively have a waist region defining a corresponding respective circumferential waist size. First spaced-apart belt loops are circumferentially affixed to the waist section of the coverall garment, and are configured to selectively receive a belt for a first user which has a first user vertical height that ranges within a first user vertical height range. Second spaced-apart belt loops are positioned relative to the first spaced-apart belt loops, and are circumferentially affixed to the waist section of the coverall garment. The second spaced-apart belt loops are configured to selectively receive the belt for a second user which has a second user vertical height that ranges within a second user vertical height range.

17 Claims, 16 Drawing Sheets

(51) Int. Cl.

| | |
|---|---|
| *A41D 13/05* | (2006.01) |
| *A41D 13/06* | (2006.01) |
| *A41D 13/08* | (2006.01) |
| *A41D 31/00* | (2006.01) |

(56) References Cited

U.S. PATENT DOCUMENTS

| | | | | |
|---|---|---|---|---|
| 4,188,672 | A * | 2/1980 | Kalso | A41F 9/025 128/96.1 |
| 4,613,991 | A | 9/1986 | Grover | |
| 4,920,577 | A | 5/1990 | Scarf | |
| 5,052,052 | A * | 10/1991 | Gilford | A41D 13/015 2/16 |
| 5,105,473 | A | 4/1992 | Valtakari | |
| 5,134,726 | A | 8/1992 | Ross | |
| 5,497,511 | A | 3/1996 | Zade | |
| 5,551,084 | A | 9/1996 | Freese | |
| 5,658,246 | A | 8/1997 | Saca | |
| 5,680,657 | A | 10/1997 | Valtakari | |
| 5,689,832 | A * | 11/1997 | Head | A41D 1/062 2/227 |
| 5,729,832 | A | 3/1998 | Grilliot et al. | |
| 5,918,310 | A | 7/1999 | Farahany | |
| 6,049,906 | A | 4/2000 | Aldridge | |
| 6,062,220 | A * | 5/2000 | Whitaker | A41D 13/11 128/206.12 |
| 6,070,274 | A | 6/2000 | Van Der Sleesen | |
| 6,148,442 | A | 11/2000 | Porter | |
| 6,260,196 | B1 | 7/2001 | Van Der Sleesen | |
| 6,289,524 | B1 | 9/2001 | Wright et al. | |
| 6,453,791 | B1 | 9/2002 | Seitzinger | |
| 6,477,711 | B1 | 11/2002 | Freeman et al. | |
| 6,654,962 | B2 | 12/2003 | Demott | |
| 6,961,958 | B1 | 11/2005 | Seitzinger | |
| 7,181,774 | B2 | 2/2007 | Silver | |
| 7,596,816 | B1 * | 10/2009 | Henry | A41F 9/00 2/227 |
| 7,784,116 | B2 | 8/2010 | Gallo et al. | |
| 7,913,322 | B2 | 3/2011 | Aldridge | |
| 7,992,221 | B2 | 8/2011 | Sonner | |
| 8,661,563 | B2 | 3/2014 | Evans et al. | |
| 9,364,034 | B2 | 6/2016 | Best | |
| D789,038 | S * | 6/2017 | McKisic | D2/742 |
| 9,848,660 | B1 * | 12/2017 | Castro | A41F 9/00 |
| 2004/0148685 | A1 | 8/2004 | Messinger | |
| 2005/0075046 | A1 | 4/2005 | Williams | |
| 2005/0229282 | A1 | 10/2005 | Davis | |
| 2005/0246820 | A1 * | 11/2005 | Davenport | A41B 9/001 2/227 |
| 2006/0117464 | A1 | 6/2006 | Capstran | |
| 2006/0277651 | A1 | 12/2006 | Razzaghi et al. | |
| 2007/0094763 | A1 | 5/2007 | Silver | |
| 2008/0134407 | A1 | 6/2008 | Winterhalter et al. | |
| 2008/0276357 | A1 | 11/2008 | Sigmon et al. | |
| 2008/0307569 | A1 | 12/2008 | Roberts | |
| 2010/0088795 | A1 | 4/2010 | Simione | |
| 2011/0157863 | A1 | 6/2011 | Grimshaw | |
| 2011/0235311 | A1 | 9/2011 | Stone | |
| 2012/0131729 | A1 | 5/2012 | Hernandez | |
| 2013/0000008 | A1 * | 1/2013 | Mizutani | A41D 13/0506 2/22 |
| 2013/0077289 | A1 | 3/2013 | Gridley | |
| 2014/0096304 | A1 * | 4/2014 | Martinez | A41F 9/02 2/79 |
| 2014/0215679 | A1 | 8/2014 | Habip | |
| 2014/0304900 | A1 | 10/2014 | Sugano et al. | |
| 2014/0376209 | A1 | 12/2014 | Leung | |
| 2015/0096095 | A1 | 4/2015 | Valenti et al. | |
| 2015/0149115 | A1 | 5/2015 | Belt | |
| 2017/0143053 | A1 | 5/2017 | Wright | |

OTHER PUBLICATIONS

HOEY, Second Office Action for U.S. Appl. No. 14/5874,986, dated Dec. 18, 2017.

HOEY, Final Office Action for U.S. Appl. No. 14/854,986, dated Jul. 3, 2018.

* cited by examiner

COVERALL GARMENT HAVING FIRST SPACED-APART BELT LOOPS

TECHNICAL FIELD

This document relates to the technical field of (and is not limited to) a coverall garment having spaced-apart belt loops. In addition, this document relates to the technical field of (and is not limited to) a coverall garment including knee compartments, elbow compartments, and a tailbone compartment configured to selectively receive an armor pad therein.

BACKGROUND

Personal protective equipment refers to protective clothing, helmets, goggles, or other garments or equipment designed (configured) to protect the wearer's body from injury and/or infection. The hazards addressed by protective equipment include physical, electrical, heat, chemicals, biohazards, and airborne particulate matter. Protective equipment may be worn for job-related occupational safety. Protective clothing refers to traditional categories of clothing, and protective gear refers to items such as pads, guards, shields, or masks, and others.

SUMMARY

It will be appreciated that there exists a need to mitigate (at least in part) at least one problem associated with existing personal protective equipment (also called the existing technology). After much study of the known systems and methods with experimentation, an understanding of the problem and its solution has been identified and is articulated as follows:

The purpose of personal protective equipment is to reduce employee exposure to hazards when engineering and administrative controls are not feasible or effective to reduce these risks to acceptable levels. Personal protective equipment is needed when there are hazards present. Personal protective equipment has the serious limitation that it does not eliminate the hazard at source and may result in employees being exposed to the hazard if the equipment fails.

Personal protective equipment imposes a barrier between the wearer (user) and the working environment, which may create additional strains on the wearer, such as: impairing their ability to carry out their work and creating significant levels of discomfort (for the user). Any of these issues may discourage wearers (users) from using the personal protective equipment correctly, placing them at risk of injury, ill-health or, under extreme circumstances, death, etc.

Practices of occupational health and safety may use hazard controls and interventions to mitigate workplace hazards, which pose a threat to the safety and quality of life of workers. The hierarchy of hazard control provides a policy framework that ranks the types of hazard controls in terms of absolute risk reduction. At the top of the hierarchy are elimination and substitution, which remove the hazard entirely or replace the hazard with a safer alternative. If elimination or substitution measures cannot apply, engineering controls and administrative controls, which seek to design safer mechanisms and coach safer human behavior, are implemented. Personal protective equipment ranks last on the hierarchy of controls, as the workers are regularly exposed to the hazard, with a barrier of protection. The hierarchy of controls is important in acknowledging that, while personal protective equipment has tremendous utility, it is not the desired mechanism of control in terms of worker safety.

What appears to be lacking is personal protective equipment for protecting a bone joint of the user wearing personal protective equipment. What is needed is personal protective equipment that improves (at least in part) protection of the bone joint against bone-joint injury resulting from a sudden impact force received by the bone joint of the user of the personal protective equipment, while the personal protective equipment provides other forms of protection for the user.

To mitigate, at least in part, at least one problem associated with the existing technology, there is provided (in accordance with a major aspect) personal protective equipment. The personal protective equipment is for use by a user having a bone joint, and for use with an armour member (a physical protection device) configured to span across the bone joint.

In accordance with a first aspect, there is provided a personal protective equipment that includes a garment assembly configured to be thermally insulated and fire resistant. The garment assembly is also configured to be worn by the user in such a way that the garment assembly (in use) spans across the bone joint of the user. A pocket assembly is configured to be thermally insulated and fire resistant. The pocket assembly is spatially positioned on and affixed to the garment assembly in such a way that the pocket assembly (in use) spans across the bone joint of the user once the user wears (in use) the garment assembly. The pocket assembly is configured to securely receive the armour member in such a way that once the user (in use) wears the garment assembly and once the pocket assembly (in use) receives the armour member: (A) the armour member spans across the bone joint of the user, and (B) the armour member is securely positioned across the bone joint of the user (thereby improving protection of the bone joint against bone-joint injury resulting from a sudden impact force received by the armour member). The pocket assembly is also configured to make direct contact with the sudden impact force received by the user in such a way that: (A) the armour member never directly receives the sudden impact force while the armour member is received by the pocket assembly, and (B) the pocket assembly directly receives the sudden impact force that is transferred from the pocket assembly to the armour member. The pocket assembly includes a wear-resistant material configured to resist wear (for instance, as a result of the pocket assembly receiving the sudden impact force). A touch fastener assembly is fixedly coupled to any one of the pocket assembly and the garment assembly. The touch fastener assembly is configured to selectively securely open and close the pocket assembly in such a way that the armour member that is received in the pocket assembly is securely retained in the pocket assembly and is securely spatially positioned to span across the bone joint of the user. The touch fastener assembly is also configured to selectively open and close the pocket assembly in such a way that the armour member that is securely received in the pocket assembly is entirely removable from the pocket assembly.

In accordance with a second aspect, there is provided an apparatus that includes a coverall garment having a waist section, and the coverall garment is configured to be worn by a range of users, in which users each respectively have a waist region defining a corresponding respective circumferential waist size that is different between the users. First spaced-apart belt loops are circumferentially affixed to the waist section of the coverall garment. The first spaced-apart belt loops are configured to selectively receive a belt for a first user which has a first user vertical height that ranges within a first user vertical height range. This is done in such a way that the first spaced-apart belt loops, in use, improve, at least in part, fit of the coverall garment to the first user once (A) the first spaced-apart belt loops, in use, selectively receive the belt, and (B) the coverall garment is worn by the first user (in which the user employs the belt). Second spaced-apart belt loops are positioned relative to the first spaced-apart belt loops. The second spaced-apart belt loops are circumferentially affixed to the waist section of the coverall garment. The second spaced-apart belt loops are configured to selectively receive the belt for a second user which has a second user vertical height that ranges within a second user vertical height range. This is done in such a way that the second spaced-apart belt loops, in use, improve, at least in part, the fit of the coverall garment to the second user once (A) the second spaced-apart belt loops, in use, selectively receive the belt, and (B) the coverall garment is worn by the second user, in which the second user employs the belt.

In accordance with a third aspect, there is provided an apparatus that includes a coverall garment configured to be worn by a user having knees, elbows and a tailbone. The coverall garment includes knee compartments configured to securely receive knee armor pads. This is done in such a way that the knee compartments securely receive and position the knee armor pads over the knees of the user once the coverall garment is worn by the user. Elbow compartments are spaced apart from the knee compartments. The elbow compartments are configured to securely receive elbow armor pads. This is done in such a way that the elbow compartments securely receive and position the elbow armor pads over the elbows of the user once the coverall garment is worn by the user. A tailbone compartment is spaced apart from the elbow compartments and the knee compartments. The tailbone compartment is configured to securely receive a tailbone armor pad. This is done in such a way that the tailbone compartment securely receives and positions the tailbone armor pad over the tailbone of the user once the coverall garment is worn by the user.

Other aspects are identified in the claims. Other aspects and features of the non-limiting embodiments may now become apparent to those skilled in the art upon review of the following detailed description of the non-limiting embodiments with the accompanying drawings. This Summary is provided to introduce concepts in simplified form that are further described below in the Detailed Description. This Summary is not intended to identify key features or essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

BRIEF DESCRIPTION OF THE DRAWINGS

The non-limiting embodiments may be more fully appreciated by reference to the following detailed description of the non-limiting embodiments when taken in conjunction with the accompanying drawings, in which.

Figure 1:
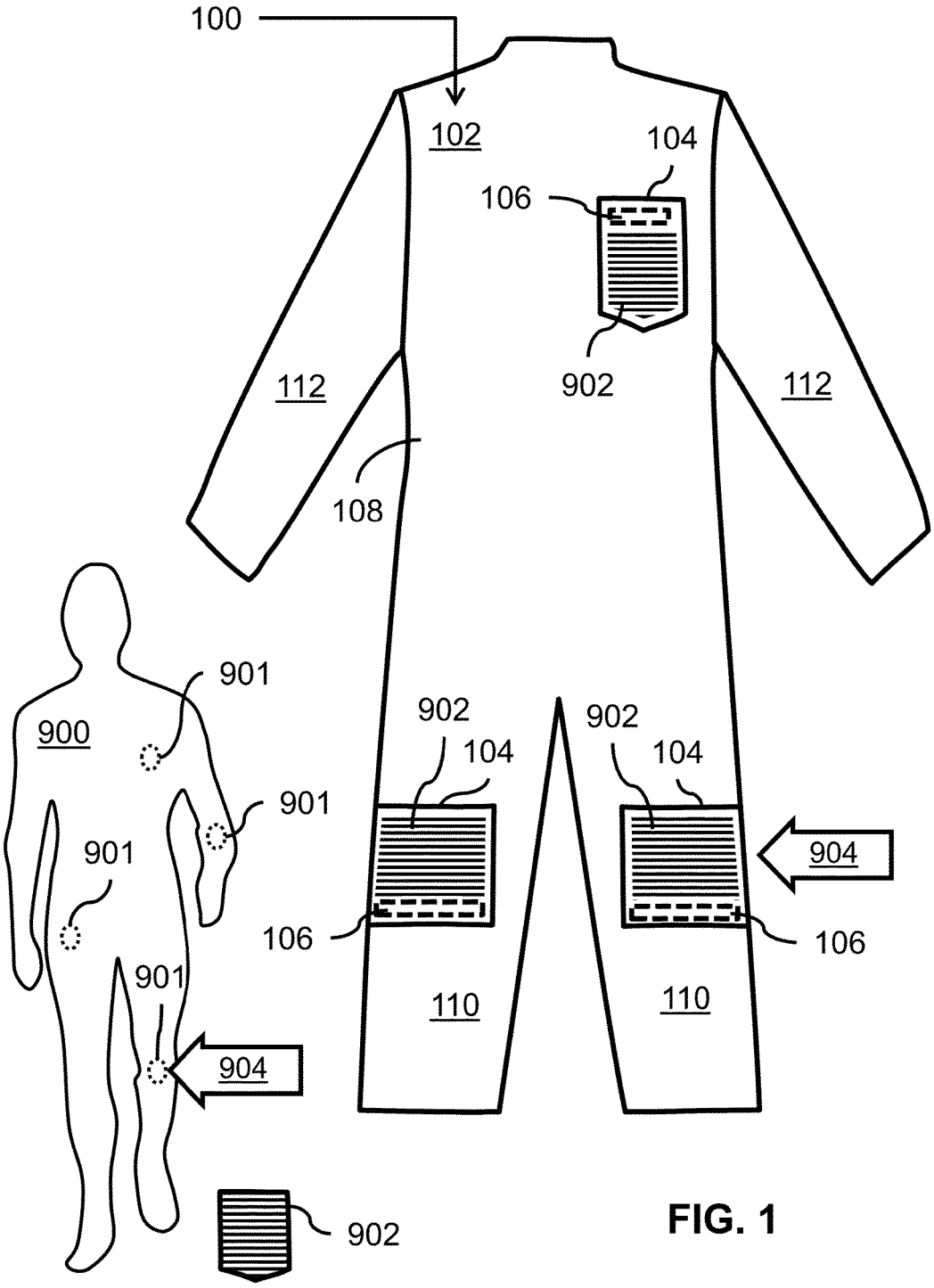
FIG. 1 depicts a front view of an embodiment of the personal protective equipment for use by a user.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted. Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

100 personal protective equipment
102 garment assembly
104 pocket assembly
106 touch fastener assembly
108 body section
110 leg sections
112 arm sections
114 light-reflective elements
116 coverall garment
117 waist section
118 interior garment surface
120 interior waist section
122 first spaced-apart belt loops
124 first user vertical height range
126 second spaced-apart belt loops
128 second user vertical height range
130 first height limit
132 second height limit
134 third height limit
136 fourth height limit
138 third spaced-apart belt loops
141 third vertical height range
142 knee compartments
144 elbow compartments
146 tailbone compartment
900 user
901 bone joint
902 armour member

903 second user
904 sudden impact force
905 third user
906 waist region
907 first user
908 belt
910 knees
920 elbows
922 tailbone
924 knee armor pads
926 elbow armor pads
928 tailbone armor pad
930 cooling armour pad
932 base section
934 cooling portion

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of may be defined by the claims (in which the claims may be amended during patent examination after filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described.

FIG. 1 depicts a front view of an embodiment of personal protective equipment 100 for use by a user 900.

The personal protective equipment 100 is for use by a user 900 having a bone joint 901. The personal protective equipment 100 is also for use with an armour member 902 configured to span across the bone joint 901 of the user 900 (once the armour member 902 is positioned accordingly). For instance, the bone joint 901 includes (and is not limited to) any one of an elbow bone joint, a knee bone joint, a hip bone joint, a rib bone joint, etc., and/or any equivalent thereof. For instance, the armour member 902 includes (and is not limited to) any one of a sheet of plastic material, a leather material, a metal plate, a composite material, and in any combination and/or permutation, and/or any equivalent thereof. The armour member 902 is configured to provide a protective covering that is configured to prevent (at least in part) damage from being inflicted on the bone joint 901 of the user 900, and/or any other part of the user 900.

The personal protective equipment 100 includes (and is not limited to) a synergistic combination of a garment assembly 102, a pocket assembly 104 and a touch fastener assembly 106. More specifically, the garment assembly 102 is configured to be thermally insulated and fire resistant. For instance, the garment assembly 102 includes a thermal insulation layer (preferably, having a thermal-insulation fabric) and/or a fire-resistant layer (preferably, having a fire-resistant fabric material) placed over the thermal insulation layer. The thermal insulation layer is configured to resist the flow of heat (thereby keeping the user 900 relatively safe from excessive heat for at least some time until the user 900 may escape to a safer place). The fire-resistant layer is configured to resist burning and/or withstand heat. The garment assembly 102 is also configured to be worn by the user 900. This is done in such a way that the garment assembly 102 (in use) spans across the bone joint 901 of the user 900.

More specifically, the pocket assembly 104 is configured to be thermally insulated and fire resistant. For instance, the pocket assembly 104 includes a thermal insulation layer (preferably, having a thermal-insulation fabric) and/or a fire-resistant layer (preferably, having a fire-resistant fabric material) placed over the thermal insulation layer. The pocket assembly 104 is spatially positioned on, and affixed to, the garment assembly 102. This is done in such a way that the pocket assembly 104 (in use) spans across the bone joint 901 of the user 900 once the user 900 wears (in use) the garment assembly 102.

The pocket assembly 104 is configured to securely receive (at least in part) the armour member 902. This is done in such a way that once the user 900 (in use) wears the garment assembly 102 and once the pocket assembly 104 (in use) receives the armour member 902: (A) the armour member 902 spans across the bone joint 901 of the user 900, and (B) the armour member 902 is securely positioned across (preferably, across and over) the bone joint 901 of the user 900. This arrangement (thereby) improves (at least in part) protection of the bone joint 901 against bone-joint injury that may result from a sudden impact force 904 received by the armour member 902 (that is, while the armour member 902 is received by the pocket assembly 104, and while the garment assembly 102 is worn by the user 900). The pocket assembly 104 is also configured to make direct contact with the sudden impact force 904 received by the user 900. This is done in such a way that: (A) the armour member 902 never directly receives the sudden impact force 904 (while the armour member 902 is received by the pocket assembly 104), and (B) the pocket assembly 104 directly receives the sudden impact force 904 that is transferred from the pocket assembly 104 to the armour member 902. This arrangement prevents wear or degradation of the armour member 902, thereby maintaining the integrity of the armour member 902 (for the case where the armour member 902 is required to protect the bone joint 901 of the user 900). The pocket assembly 104 includes a wear-resistant material configured to resist wear (for the case where, or as a result of, the pocket assembly 104 receives the sudden impact force 904, for instance). The wear-resistant material may include a wear-resistant fabric material, a wear-resistant component, and/or any equivalent thereof.

The touch fastener assembly 106 is fixedly coupled (connected) to any one of the pocket assembly 104 and the garment assembly 102. For instance, the touch fastener assembly 106 includes mating portions that may be positioned on the pocket assembly 104 and the garment assembly 102, etc. Preferably, the touch fastener assembly 106 is configured to be thermally insulated and fire resistant. For instance, the touch fastener assembly 106 includes a thermal insulation layer (preferably, having a thermal-insulation fabric) and/or a fire-resistant layer (preferably, having a fire-resistant fabric material) placed over the thermal insulation layer. For instance, the touch fastener assembly 106 includes any one of a snap fastener, a zipper, a VELCRO (TRADEMARK) connector, in any combination and permutation thereof, and/or any equivalent thereof. The touch fastener assembly 106 is configured to selectively securely open and close the pocket assembly 104. This is done in such a way that the armour member 902 that is received in the pocket assembly 104 is securely retained in the pocket assembly 104 and is securely spatially positioned to span across the bone joint 901 of the user 900. The touch fastener assembly 106 is also configured to selectively open (and close) the pocket assembly 104. This is done in such a way that the armour member 902 that is securely received in the pocket assembly 104 is entirely removable from the pocket assembly 104 (in such a way that another instance of the armour member 902 may be inserted into the pocket assembly 104, etc.).

In accordance with the embodiment as depicted in FIG. 1, the garment assembly 102 includes a coverall garment, and/or any equivalent thereof. The garment assembly 102 includes a body section 108 with leg sections 110 and arm sections 112 extending from the body section 108. The body section 108 may cover a substantial portion of the upper torso of the user 900.

In accordance with the embodiment as depicted in FIG. 1, an instance of the pocket assembly 104 is positioned on the body section 108 of the garment assembly 102, and is configured to cover (span) the rib bone joint. An instance of the pocket assembly 104 is positioned on each of the leg sections 110 of the garment assembly 102, and is configured to cover (span) the knee bone joint.

Preferably, the thread used in the garment assembly 102 includes an aramid high tenacity fire resistant thread. Any metal components are thermally protected from the skin of the user. The stress points are bar-tacked. The shirt collar has a protective portion. Zippers have heavy-duty brass components positioned on an aramid tape, with fire-resistant zipper teeth. A storm guard is provided over the zipper with a snap-closured mesh. Preferably, the arm cuffs of the garment assembly 102 are provided with snap closures.

Figure 2:
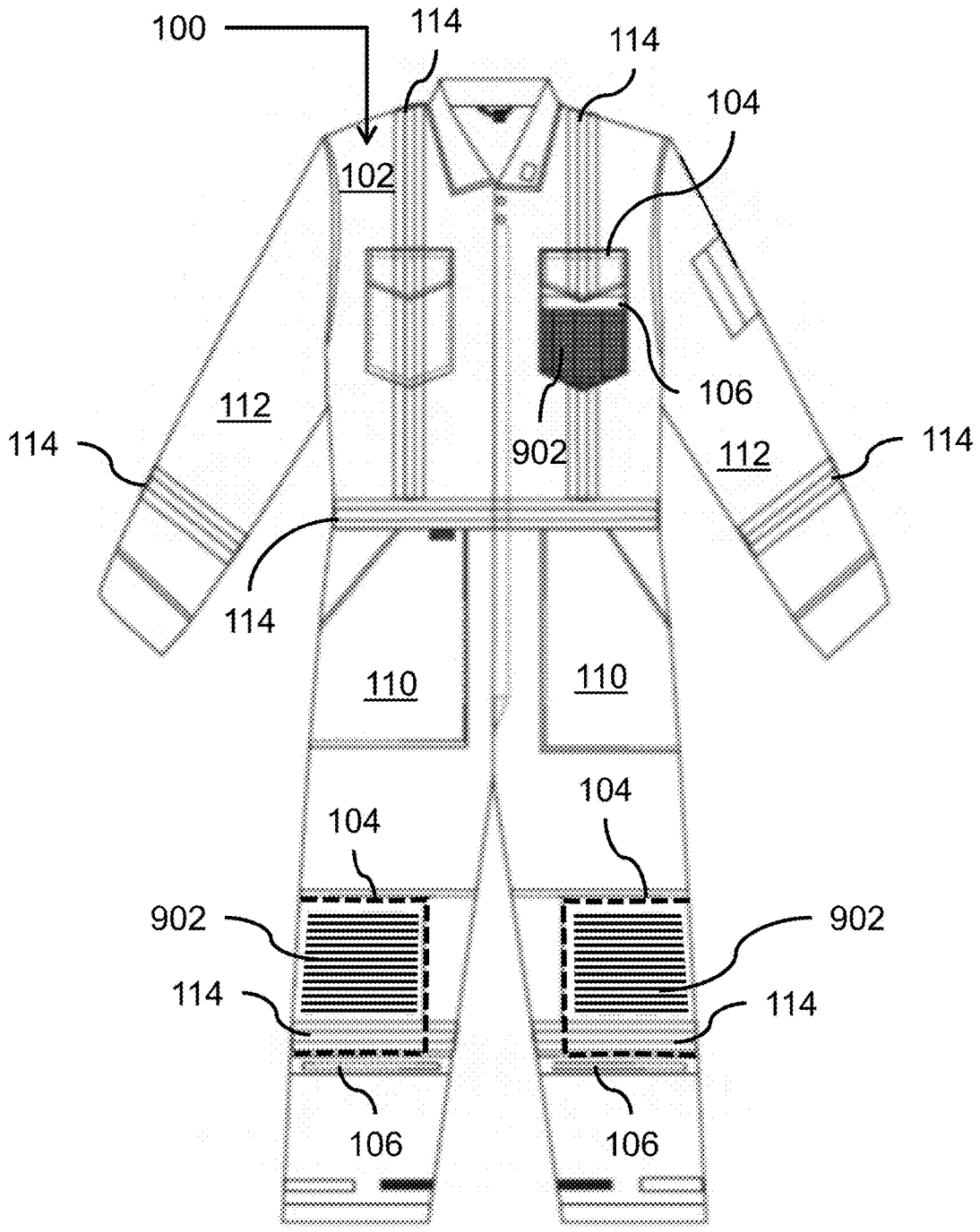
FIG. 2 depicts a front view of an embodiment of the personal protective equipment of FIG. 1.

FIG. 2 depicts a front view of an embodiment of the personal protective equipment 100 of FIG. 1.

In accordance with the embodiment as depicted in FIG. 2, the garment assembly 102 includes light-reflective elements 114 that are positioned on and affixed to any one of the body section 108, the leg sections 110 and the arm sections 112 (in any combination and/or permutation thereof). The light-reflective elements 114 may include portions of light reflective tape of various colours (such as, yellow, silver, etc.). At least one or more of the light-reflective elements 114 may include light emitting devices, such as LEDs (Light Emitting Diodes), and/or any equivalent thereof, that are configured to be powered by a battery (known and not depicted), and may also be operationally controlled by a controller (known and not depicted).

Figure 3:
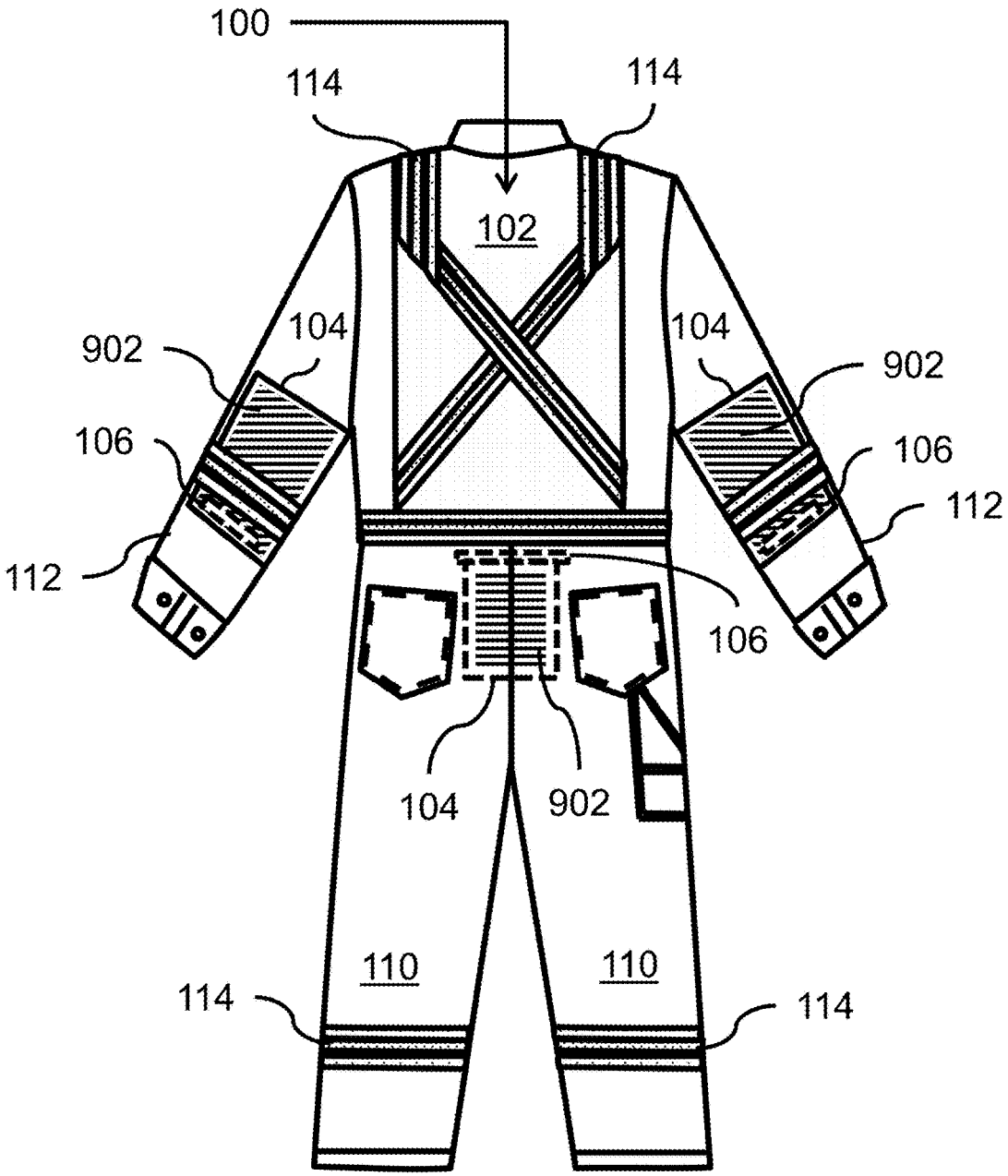
FIG. 3 depicts a rear view of an embodiment of the personal protective equipment of FIG. 1.

FIG. 3 depicts a rear view of an embodiment of the personal protective equipment 100 of FIG. 1.

In accordance with the embodiment as depicted in FIG. 3, an instance of the pocket assembly 104 is positioned on (and affixed to) the garment assembly 102 (preferably, positioned on and affixed to a pant section of the garment assembly 102). The pocket assembly 104 is configured to cover (span) the tailbone joint (once the garment assembly 102 is worn by the user 900 of FIG. 1). Preferably, an instance of the pocket assembly 104 is spatially positioned on (and affixed to) each of the arm sections 112 of the garment assembly 102, and the pocket assembly 104 is configured to cover (span) the elbow bone joint.

Figure 4:
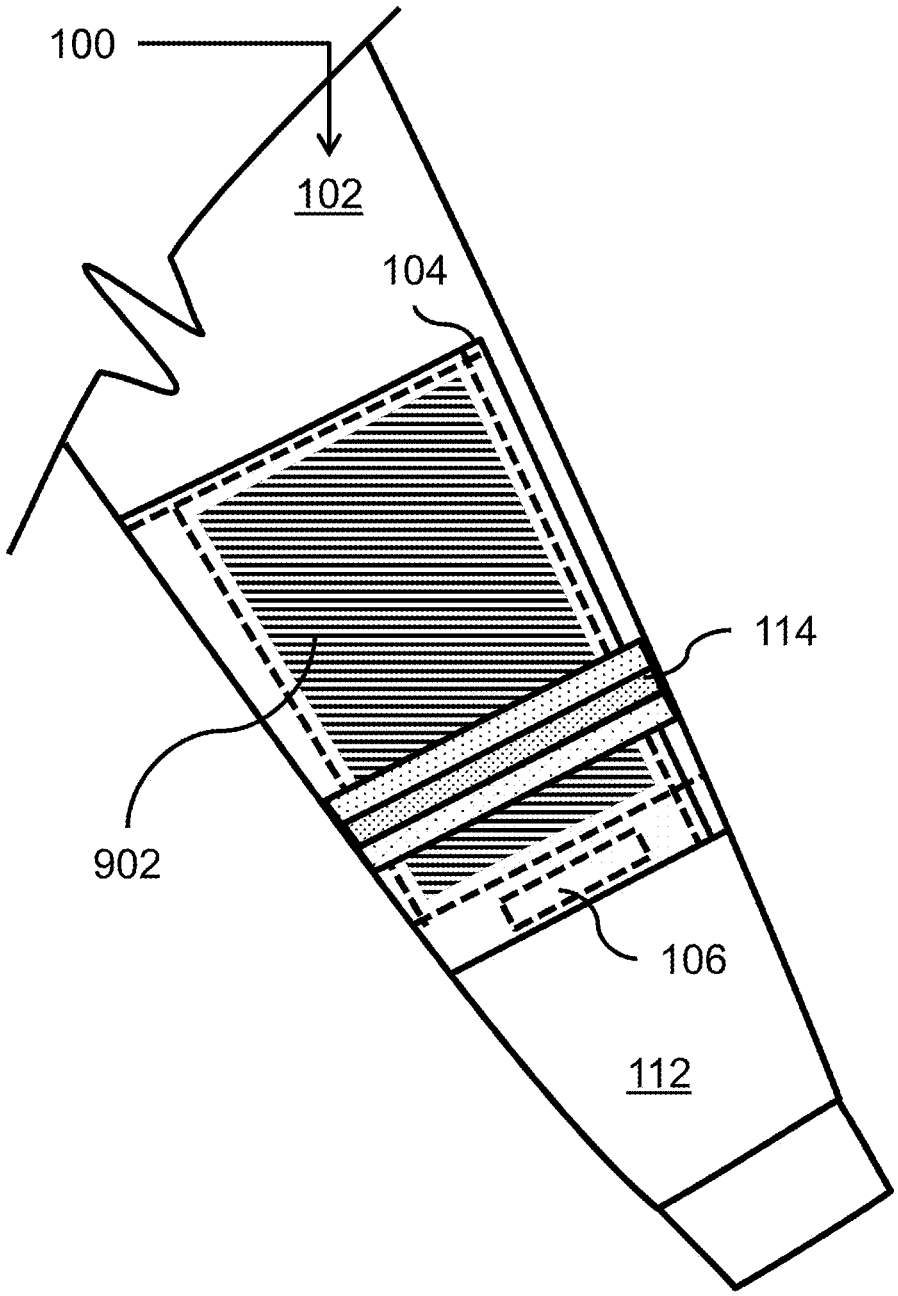
FIG. 4 depicts a rear close-up view of an embodiment of the personal protective equipment of FIG. 1.

FIG. 4 depicts a rear close-up view of an embodiment of the personal protective equipment 100 of FIG. 1.

Referring to the embodiment as depicted in FIG. 4, an instance of the pocket assembly 104 is positioned on (and affixed to) at least one of the arm sections 112 of the garment assembly 102. The pocket assembly 104 is configured to cover (span) the elbow bone joint (of the user 900 of FIG. 1, once the user 900 wears the garment assembly 102 accordingly). Preferably, the pocket assembly 104 is stitched to the garment assembly 102 (preferably along at least three sides) using a relatively high tenacity thread. The light-reflective elements 114 are positioned (aligned) to span across (at least in part) the pocket assembly 104. The touch fastener assembly 106 is positioned at the entrance of the pocket assembly 104 (leading into an interior formed by the pocket assembly 104).

Figure 5:
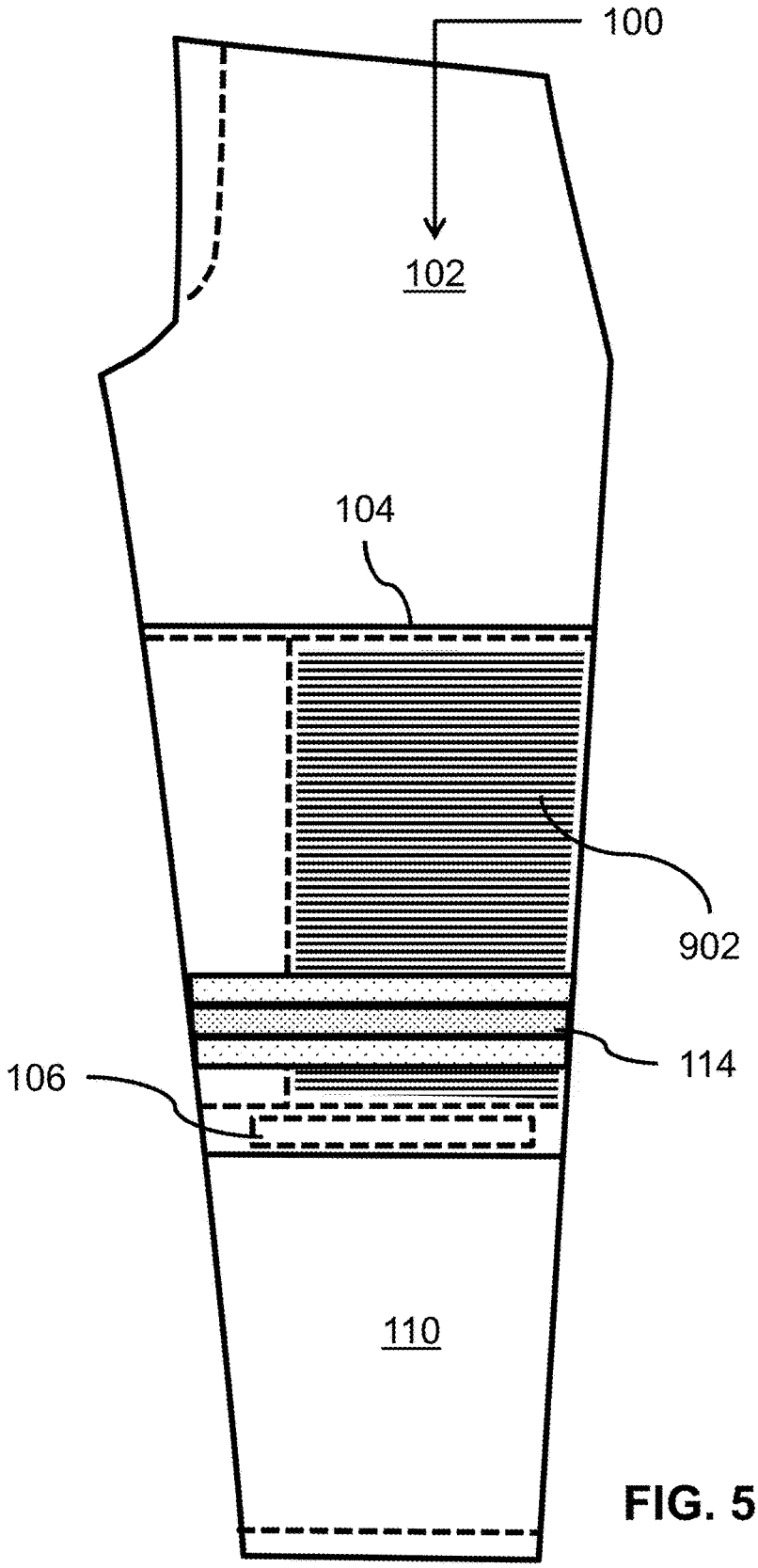
FIG. 5 depicts a front close-up view of an embodiment of the personal protective equipment of FIG. 1.

FIG. 5 depicts a front close-up view of an embodiment of the personal protective equipment 100 of FIG. 1.

Referring to the embodiment as depicted in FIG. 5, an instance of the pocket assembly 104 is positioned on (and affixed to) at least one of the leg sections 110 of the garment assembly 102. The pocket assembly 104 is configured to cover (span) the knee bone joint (of the user 900 of FIG. 1, once the user 900 wears the garment assembly 102 accordingly). Preferably, the pocket assembly 104 is stitched to the garment assembly 102 (along at least three sides, for instance) using a relatively high tenacity thread. The light-reflective elements 114 are positioned (aligned) to span across (at least in part) the pocket assembly 104. The touch fastener assembly 106 is positioned at the entrance of the pocket assembly 104 (leading into an interior formed by the pocket assembly 104).

Figure 6:
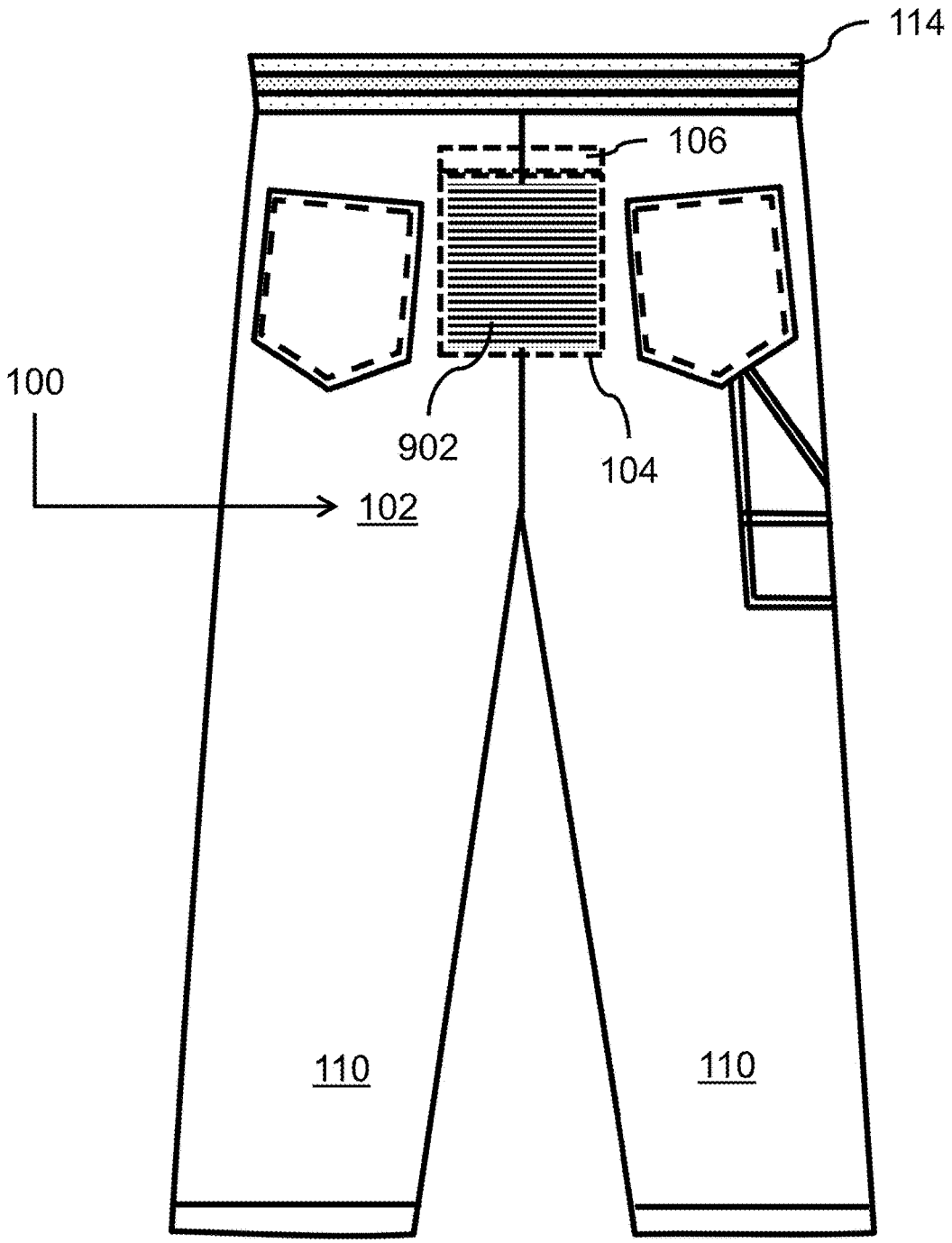
FIG. 6 depicts a rear close-up view of an embodiment of the personal protective equipment of FIG. 1.

FIG. 6 depicts a rear close-up view of an embodiment of the personal protective equipment 100 of FIG. 1.

In accordance with the embodiment as depicted in FIG. 6, an instance of the pocket assembly 104 is positioned on (and affixed to) the garment assembly 102 (preferably on a pant section of the garment assembly 102). The pocket assembly 104 is configured to cover (span) the tailbone joint (of the user 900 of FIG. 1, once the user 900 wears the garment assembly 102 accordingly).

FIGS. 7, 8, 9 and 10 depict front views (FIGS. 7, 9 and 10) and a rear view (FIG. 8) of the embodiments of an apparatus including a coverall garment 116 having spaced-apart belt loops.

The coverall garment 116 is a full-length protective outer garment (covering the user from the ankles to the neck (of the user), or from the head to the toes of the user. The coverall garment 116 may, in accordance with an option, also cover or extend over the length of the arms of the user to the wrists of the user. The coverall garment 116 may be zipped open or closed, with a zipper assembly that is aligned along the front section of the coverall garment 116.

In accordance with a first major aspect as depicted in FIGS. 7 to 10, the apparatus includes (and is not limited to) a synergistic combination of a coverall garment 116, an interior waist section 120, first spaced-apart belt loops 122, and second spaced-apart belt loops 126.

The coverall garment 116, the first spaced-apart belt loops 122 and the second spaced-apart belt loops 126 may include a flexible material or webbing, etc. The coverall garment 116 is configured (sized) to be worn by a range of users (such as, and not limited to, a first user 907 as depicted in FIG. 7 and FIG. 8, a second user 903 as depicted in FIG. 9, and a third user 905 as depicted in FIG. 10).

The users each respectively have a waist region 906 defining a corresponding respective circumferential waist size that is different between the users. That is, each user may have a different body type. The respective waist region 906 of each user (that is, the first user 907, the second user 903, and the third user 905) has a corresponding (respective) circumferential waist size that is different between the users. For instance, the users have relatively different vertical heights, and therefore each user likely may have relatively different waist sizes (and/or body types).

Figure 7:
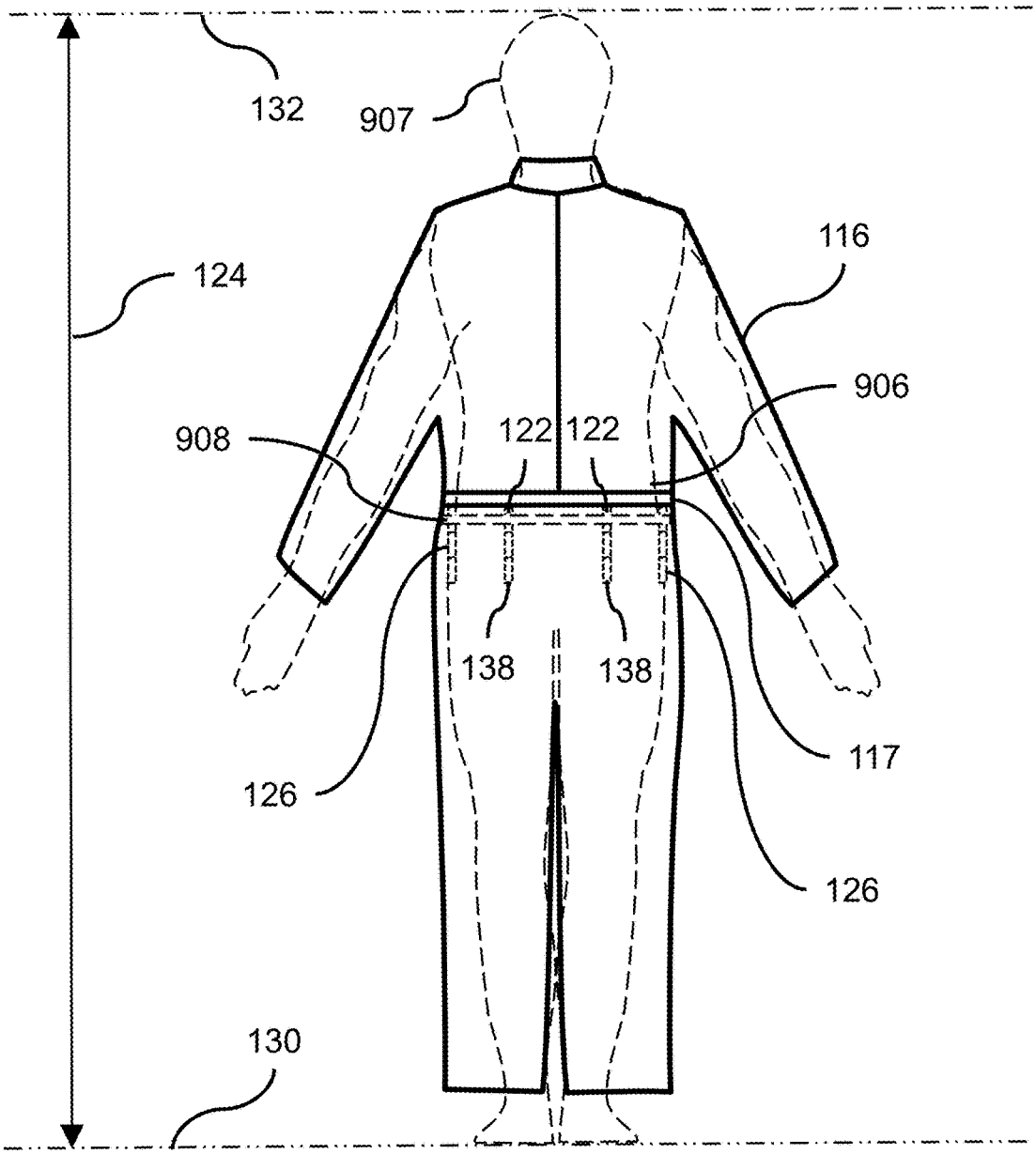
FIGS. 7, 8, 9 and 10 depict front views (FIGS. 7, 9 and 10) and a rear view (FIG. 8) of embodiments of an apparatus including a coverall garment having spaced-apart belt loops.
Figure 8:
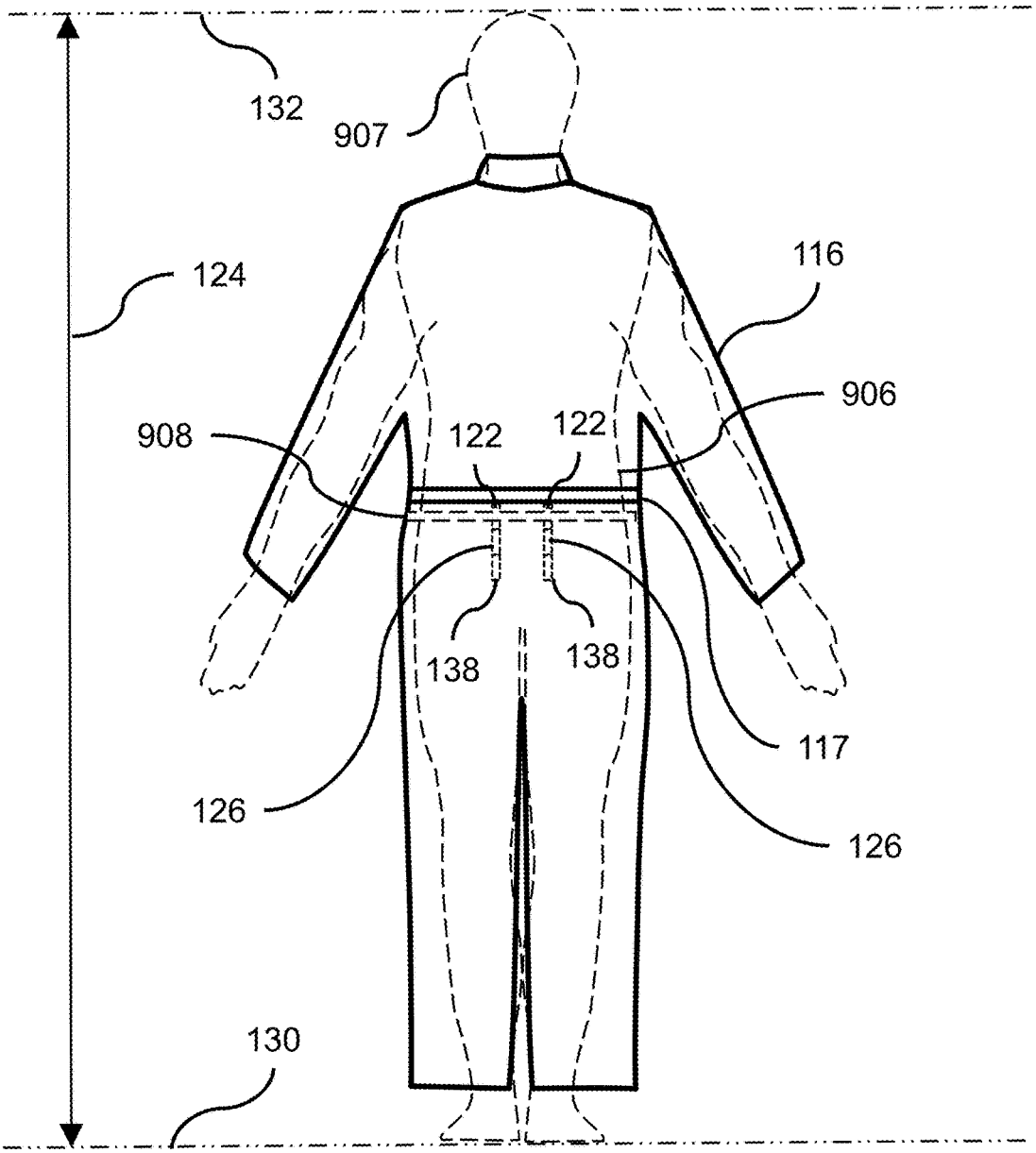

Referring to the embodiment as depicted in FIG. 7 (a front view) and FIG. 8 (a rear view), the first spaced-apart belt loops 122 are circumferentially affixed to (stitched to) the waist section 117 of the coverall garment 116. Preferably, the first spaced-apart belt loops 122 are circumferentially affixed to an interior of the waist section 117 of the coverall garment 116. The first spaced-apart belt loops 122 are configured to selectively receive a belt 908 for a first user 907. The first user 907 has a first user vertical height that ranges within a first user vertical height range 124. This is done in such a way that the first spaced-apart belt loops 122, in use, improve, at least in part, the fit of the coverall garment 116 to the first user 907 once (A) the first spaced-apart belt loops 122, in use, selectively receive the belt 908, and (B) the coverall garment 116 is worn by the first user 907.

Figure 9:
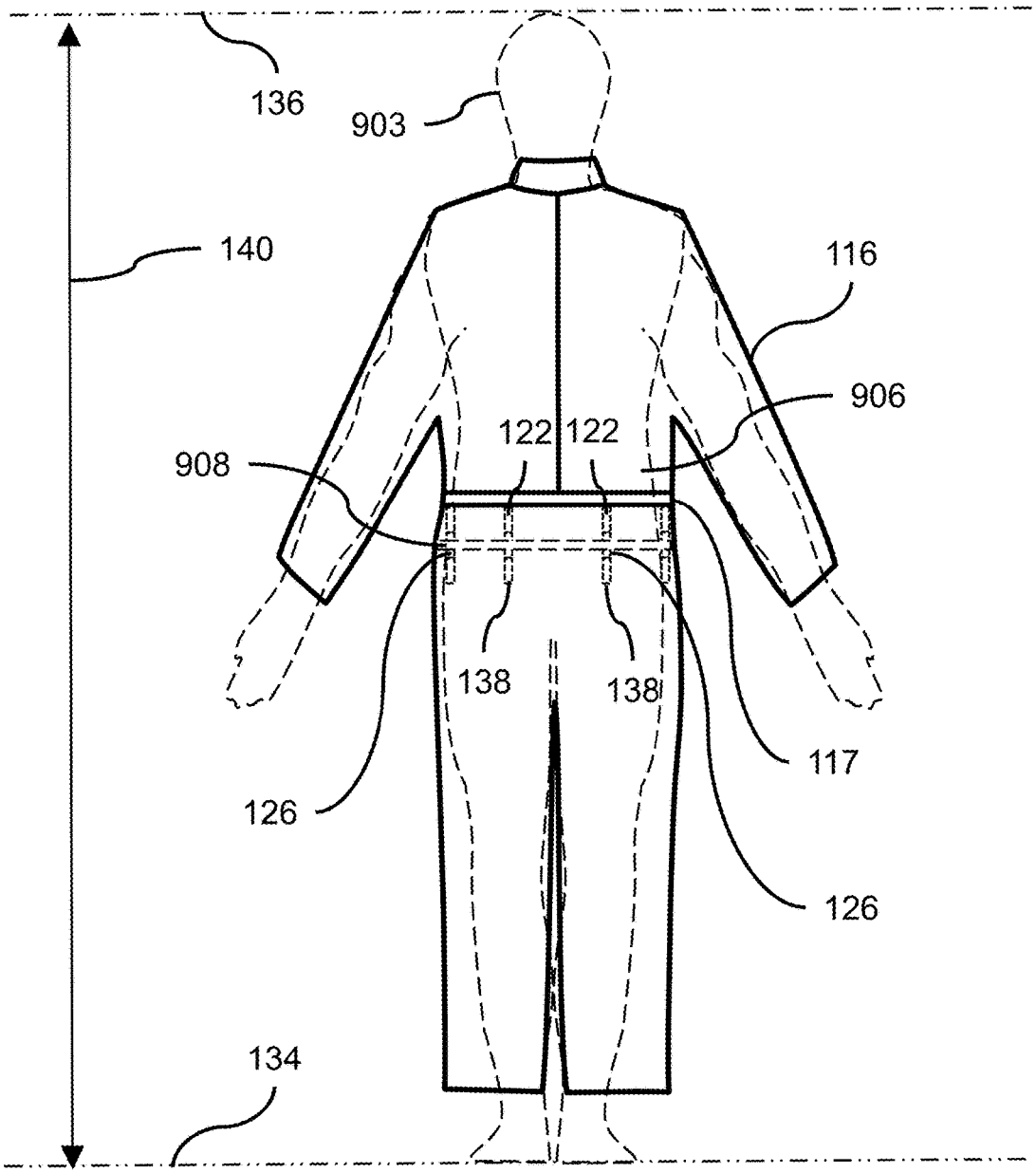
Figure 10:
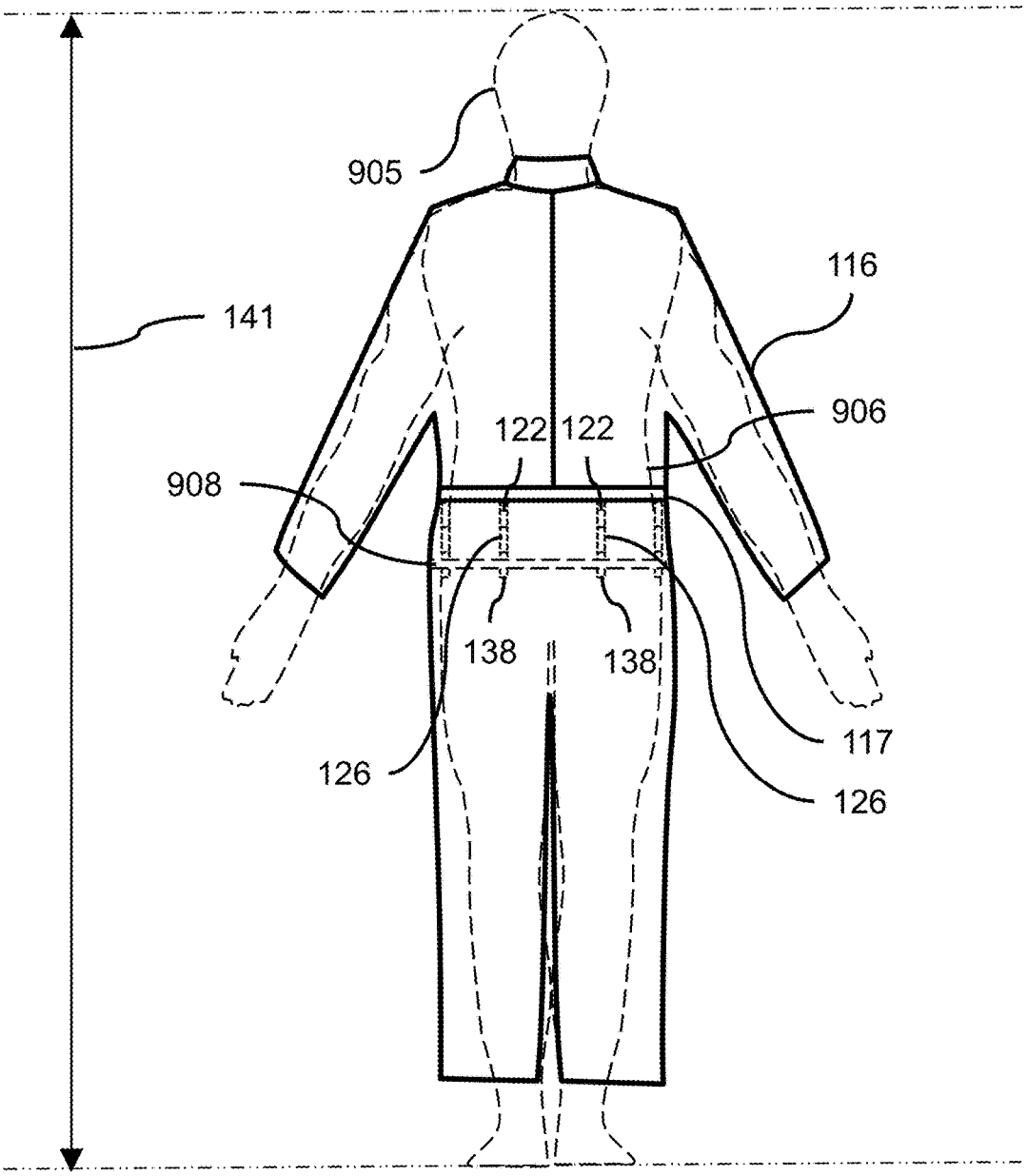

Referring to the embodiment as depicted in FIG. 9 (a front view), the second spaced-apart belt loops 126 are positioned relative to the first spaced-apart belt loops 122. Preferably, the second spaced-apart belt loops 126 are positioned vertically below the first spaced-apart belt loops 122. The second spaced-apart belt loops 126 are circumferentially affixed to the waist section 117 of the coverall garment 116. Preferably, the second spaced-apart belt loops 126 are circumferentially affixed to an interior of the waist section 117 of the coverall garment 116. The second spaced-apart belt loops 126 are configured to selectively receive the belt 908 for a second user 903. The second user 903 has a second user vertical height that ranges within a second user vertical height range 128. This is done in such a way that the second spaced-apart belt loops 126, in use, improve, at least in part, the fit of the coverall garment 116 to the second user 903 once (A) the second spaced-apart belt loops 126, in use, selectively receive the belt 908, and (B) the coverall garment 116 is worn by the second user 903.

Referring to the embodiment as depicted in FIG. 10 (a front view), the apparatus further includes third spaced-apart belt loops 138 positioned relative to the second spaced-apart belt loops 126 and the first spaced-apart belt loops 122. Preferably, the third spaced-apart belt loops 138 are circumferentially affixed to an interior of the waist section 117 of the coverall garment 116. The third spaced-apart belt loops 138 are circumferentially affixed to the waist section 117 of the coverall garment 116. The third spaced-apart belt loops 138 are configured to selectively receive the belt 908 for a third user 905. The third user 905 has a third vertical height that ranges within a third vertical height range 141. This is done in such a way that the third spaced-apart belt loops 138, in use, improve, at least in part, the fit of the coverall garment 116 to the third user 905 once (A) the third spaced-apart belt loops 138, in use, selectively receive the belt 908, and (B) the coverall garment 116 is worn by the second user 903.

A technical effect of the apparatus is that the coverall garment 116 may be usable or fitted to (or worn by) a range of users having different body types (such as, a range of vertical heights or other body-type measurements). In this manner, the same instance of the coverall garment 116 may be usable by a relatively wider range of users. The arrangement of the coverall garment 116 helps to lower the cost of manufacturing the coverall garment 116 based on a relatively larger quantity to be manufactured (since the same instance of the coverall garment 116 may be usable by a relatively wider range of users having a relatively wider range of body types). For instance, referring to FIG. 7 (showing a front view) and FIG. 8 (showing a rear view), the coverall garment 116 may be usable by a first user 907 that has a first user vertical height that ranges from about five foot two inches to about five foot five inches, in which the first user 907 selects the top-most positioned row of spaced-apart belt loops that are affixed to the inside of the coverall garment 116 (for inserting a belt 908 therethrough). For instance, referring to FIG. 9 (showing a front view), the coverall garment 116 may be usable by a second user 903 that has a second user vertical height that ranges from about five foot five inches to about five foot eight inches, in which the second user 903 selects the middle positioned row of spaced-apart belt loops that are affixed to the inside of the coverall garment 116 (for inserting a belt 908 therethrough). For instance, referring to FIG. 10 (showing a front view), the coverall garment 116 may be usable by a third user 905 that has a third vertical height that ranges from about five foot eight inches to about six foot two inches, in which the third user 905 selects the most lowest positioned row of spaced-apart belt loops that are affixed to the inside of the coverall garment 116 (for inserting a belt 908 therethrough).

In accordance with a second major aspect as depicted in FIGS. 7 to 10, the apparatus includes (and is not limited to) a synergistic combination of a coverall garment 116, an interior waist section 120, the first spaced-apart belt loops 122, and the second spaced-apart belt loops 126. The coverall garment 116 has a waist section 117. The coverall garment 116 is configured (sized) to be worn by a range of users (such as, the first user 907 as depicted in FIG. 7 and FIG. 8, the second user 903 as depicted in FIG. 9, and the third user 905 as depicted in FIG. 10).

The users each respectively have a waist region 906 defining a corresponding respective circumferential waist size that is different between the users (from user to user). The respective waist region 906 of each user (that is, the first user 907, the second user 903, and the third user 905) has a corresponding (respective) circumferential waist size that is different between the users (that is, the first user 907, the second user 903, and the third user 905). For instance, the users (that is, the first user 907, the second user 903, and the third user 905) have relatively different vertical heights, and therefore each user may have relatively different waist sizes (as a result of different user heights).

Figure 12:
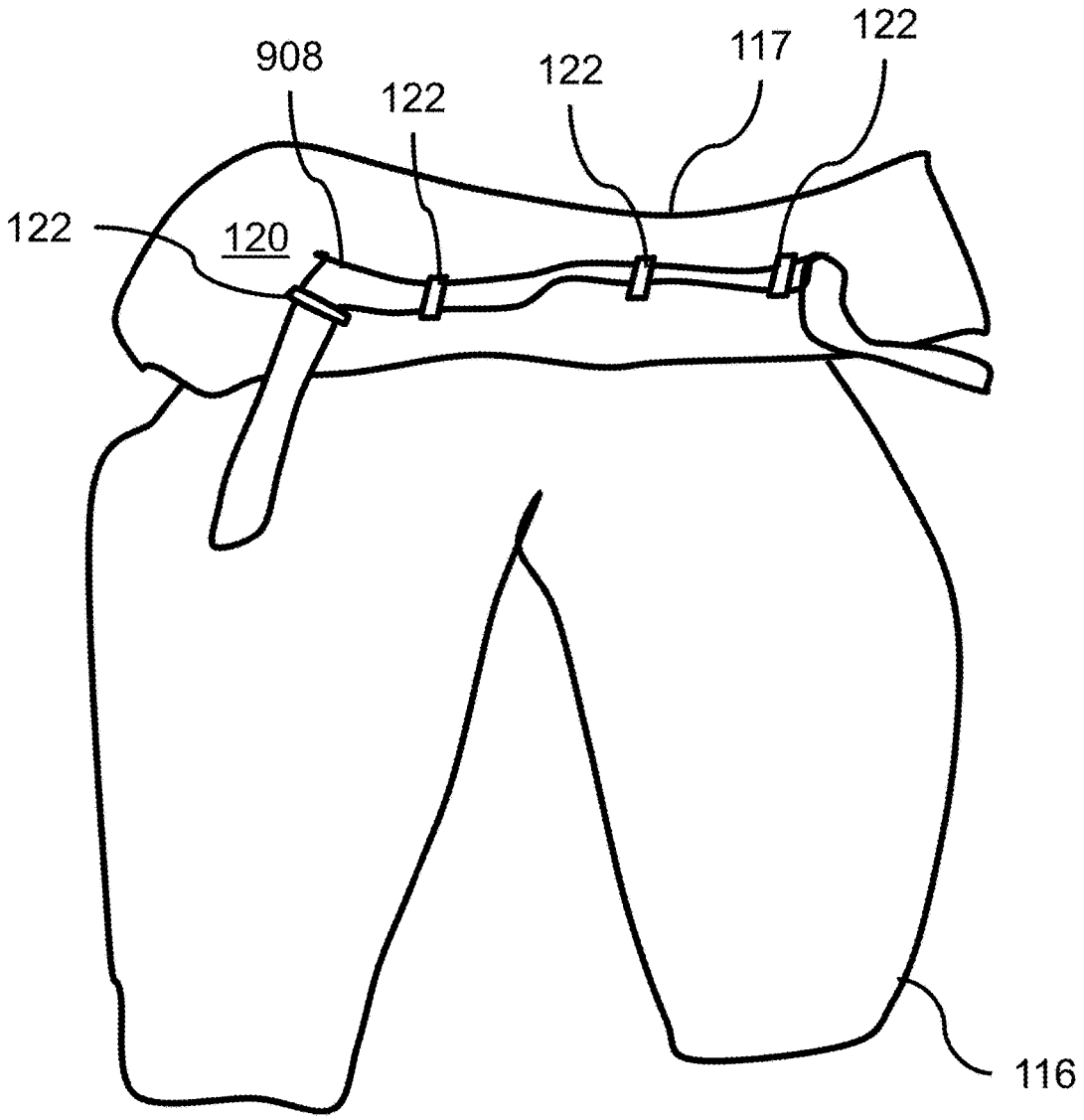

An interior waist section 120 (as depicted in FIG. 12) of the coverall garment 116 is positioned inside the coverall garment 116. The interior waist section 120 is configured to be positioned proximate to the waist region 906 of the user once the coverall garment 116 is worn by the user.

The first spaced-apart belt loops 122 are circumferentially affixed to the interior waist section 120 of the coverall garment 116. The first spaced-apart belt loops 122 are configured to selectively receive a belt 908 for the first user 907. The first user 907 has a first user vertical height that ranges within a first user vertical height range 124. This is done in such a way that the first spaced-apart belt loops 122, in use, improve, at least in part, the fit of the coverall garment 116 to the waist of the first user 907 once (A) the first spaced-apart belt loops 122, in use, selectively receive the belt 908, and (B) the coverall garment 116 is worn by the first user 907.

The second spaced-apart belt loops 126 are positioned relative to the first spaced-apart belt loops 122. The second spaced-apart belt loops 126 are circumferentially affixed to the interior waist section 120 of the interior garment surface 118 (depicted in FIG. 11) of the coverall garment 116. The second spaced-apart belt loops 126 are configured to selectively receive the belt 908 for the second user 903. The second user 903 has a second user vertical height that ranges within a second user vertical height range 128. This is done in such a way that the second spaced-apart belt loops 126, in use, improve, at least in part, the fit of the coverall garment 116 to the waist of the second user 903 once (A) the second spaced-apart belt loops 126, in use, selectively receive the belt 908, and (B) the coverall garment 116 is worn by the second user 903.

In accordance with a third major aspect as depicted in FIGS. 7 to 10, the apparatus includes (and is not limited to) a synergistic combination of a coverall garment 116, an interior waist section 120, the first spaced-apart belt loops 122, and the second spaced-apart belt loops 126. The coverall garment 116 is configured to be worn by a user having a waist region 906. The coverall garment 116 is configured (sized) to be worn by a range of users (such as, the first user 907 as depicted in FIG. 7 and FIG. 8, the second user 903 as depicted in FIG. 9, and the third user 905 as depicted in FIG. 10).

The users each respectively have a waist region 906 defining a corresponding respective circumferential waist size that is different between the users. The respective waist region 906 of each user (that is, the first user 907, the second user 903, and the third user 905) has a corresponding (respective) circumferential waist size that is different between the users. For instance, the users have relatively different vertical heights, and therefore each user may have relatively different waist sizes.

An interior garment surface 118 (depicted in FIG. 11) of the coverall garment 116 is positioned (located) inside the coverall garment 116. The interior garment surface 118 includes an interior waist section 120 configured to be positioned proximate to the waist region 906 of the user once the coverall garment 116 is worn by the user.

The first spaced-apart belt loops 122 are circumferentially affixed to the interior waist section 120 of the interior garment surface 118 of the coverall garment 116. This is done in such a way that the first spaced-apart belt loops 122 are circumferentially positioned proximate to the waist region 906 of the user once the coverall garment 116 is worn by the user. The first spaced-apart belt loops 122 are configured to selectively receive a belt 908 for the first user 907. The first user 907 has a first user vertical height that ranges within a first user vertical height range 124. This is done in such a way that the first spaced-apart belt loops 122, in use, improve, at least in part, the fit of the coverall garment 116 to the waist of the first user 907 once (A) the first spaced-apart belt loops 122, in use, selectively receive the belt 908, and (B) the coverall garment 116 is worn by the first user 907. For instance, the first user vertical height range 124 ranges between a first user height limit 130 and a second user height limit 132.

The second spaced-apart belt loops 126 are positioned relative to the first spaced-apart belt loops 122. Preferably, the second spaced-apart belt loops 126 are affixed to the interior of the coverall garment 116. The second spaced-apart belt loops 126 are circumferentially affixed to the interior waist section 120 of the interior garment surface 118 of the coverall garment 116. This is done in such a way that the second spaced-apart belt loops 126 are circumferentially positioned proximate to the waist region 906 of the user once the coverall garment 116 is worn by the user. The second spaced-apart belt loops 126 are configured to selectively receive the belt 908 for the second user 903. The second user 903 has a second user vertical height that ranges within a second user vertical height range 128. This is done in such a way that the second spaced-apart belt loops 126, in use, improve, at least in part, the fit of the coverall garment 116 to the waist of the second user 903 once (A) the second spaced-apart belt loops 126, in use, selectively receive the belt 908, and (B) the coverall garment 116 is worn by the second user 903. For instance, the second user vertical height range 128 ranges between a third user height limit 134 and a fourth user height limit 136.

In accordance with an embodiment as depicted in FIGS. 7 to 10, the apparatus is adapted such that an interior waist section 120 is positioned inside the coverall garment 116. The interior waist section 120 is configured to be positioned proximate to the waist region 906 of the user once the coverall garment 116 is worn by the user. The first spaced-apart belt loops 122 are circumferentially affixed to the interior waist section 120 of the coverall garment 116. The second spaced-apart belt loops 126 are circumferentially affixed to the interior waist section 120 of the interior garment surface 118 of the coverall garment 116. The third spaced-apart belt loops 138 are circumferentially affixed to the interior waist section 120 of the interior garment surface 118 of the coverall garment 116.

In accordance with an embodiment as depicted in FIGS. 7 to 10, the apparatus is adapted such that the first spaced-apart belt loops 122, the second spaced-apart belt loops 126, and the third spaced-apart belt loops 138 are vertically aligned and stacked one over the other. Preferably, the first spaced-apart belt loops 122, the second spaced-apart belt loops 126, and the third spaced-apart belt loops 138 are vertically aligned and stacked one over the other and form a vertically stacked column.

In accordance with an embodiment as depicted in FIGS. 7 to 10, the apparatus is adapted such that an interior garment surface 118 is positioned inside the coverall garment 116. The interior garment surface 118 includes an interior waist section 120 configured to be positioned proximate to the waist region 906 of the user once the coverall garment 116 is worn by the user. The first spaced-apart belt loops 122 are circumferentially affixed to the interior waist section 120 of the interior garment surface 118 of the coverall garment 116. The second spaced-apart belt loops 126 are circumferentially affixed to the interior waist section 120 of the interior garment surface 118 of the coverall garment 116. The third spaced-apart belt loops 138 are circumferentially affixed to the interior waist section 120 of the interior garment surface 118 of the coverall garment 116.

Figure 11:
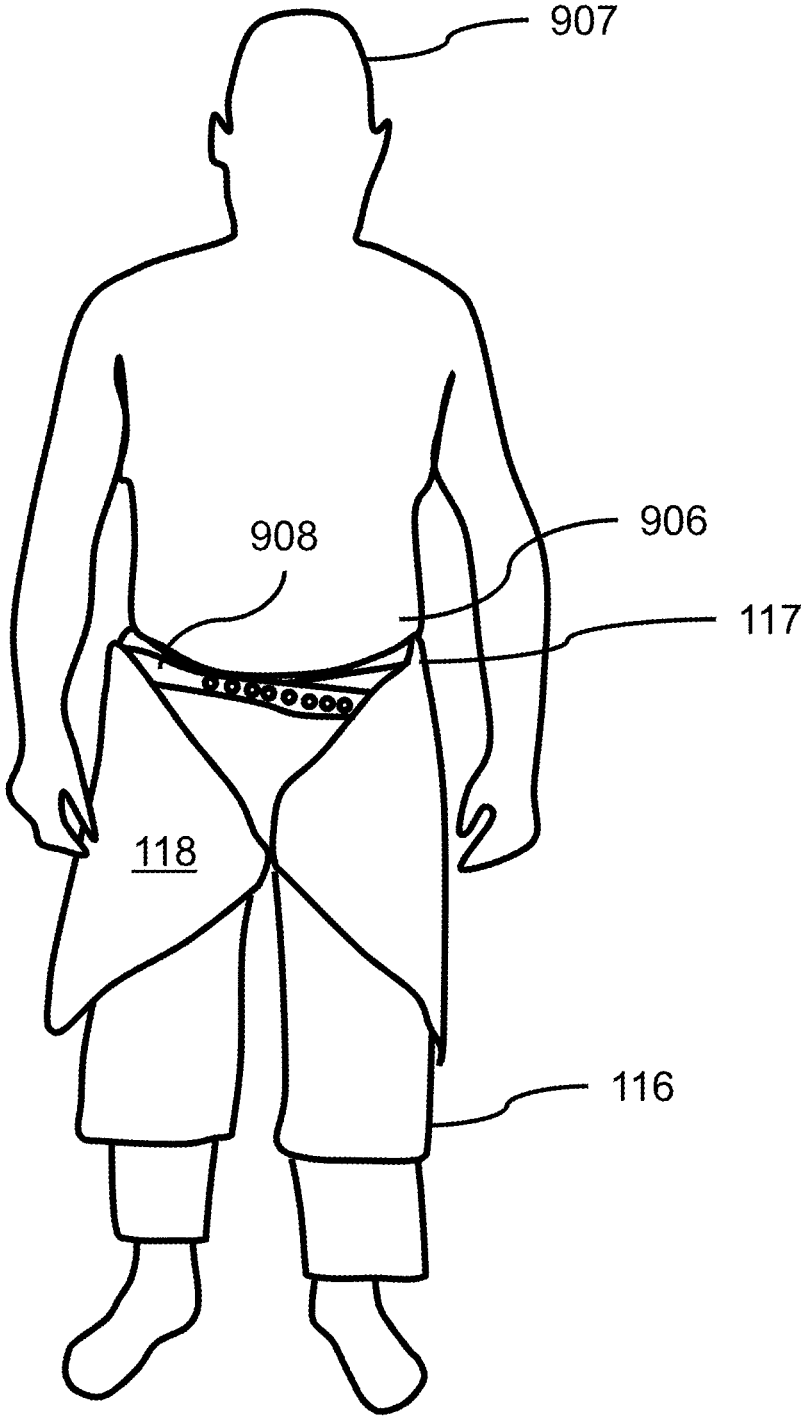
FIGS. 11 and 12 depict front perspective views of embodiments of the coverall garment of FIG. 7.

FIGS. 11 and 12 depict front perspective views of an embodiment of the coverall garment 116 of FIG. 7.

In accordance with FIG. 11, the coverall garment 116 has been partially removed (peeled from) the first user 907 in order to reveal the belt 908. In accordance with FIG. 12, the coverall garment 116 has been entirely removed from the first user 907 of FIG. 11, in order to reveal the belt 908 and the first spaced-apart belt loops 122.

FIGS. 13 to 20 depict front views (FIGS. 13, 14, 16 and 19), a rear view (FIGS. 15 and 17), and a side view (FIG. 20) of embodiments of an apparatus including a coverall garment 116 having knee compartments 142, elbow compartments 144, and a tailbone compartment 146.

In accordance with a fourth major aspect as depicted in FIGS. 7 to 10, the apparatus includes (and is not limited to) a synergistic combination of a coverall garment 116 including knee compartments 142, elbow compartments 144, and a tailbone compartment 146. The coverall garment 116 is configured to be worn by a user 900 having knees 910, elbows 920 and a tailbone 922.

Figure 13:
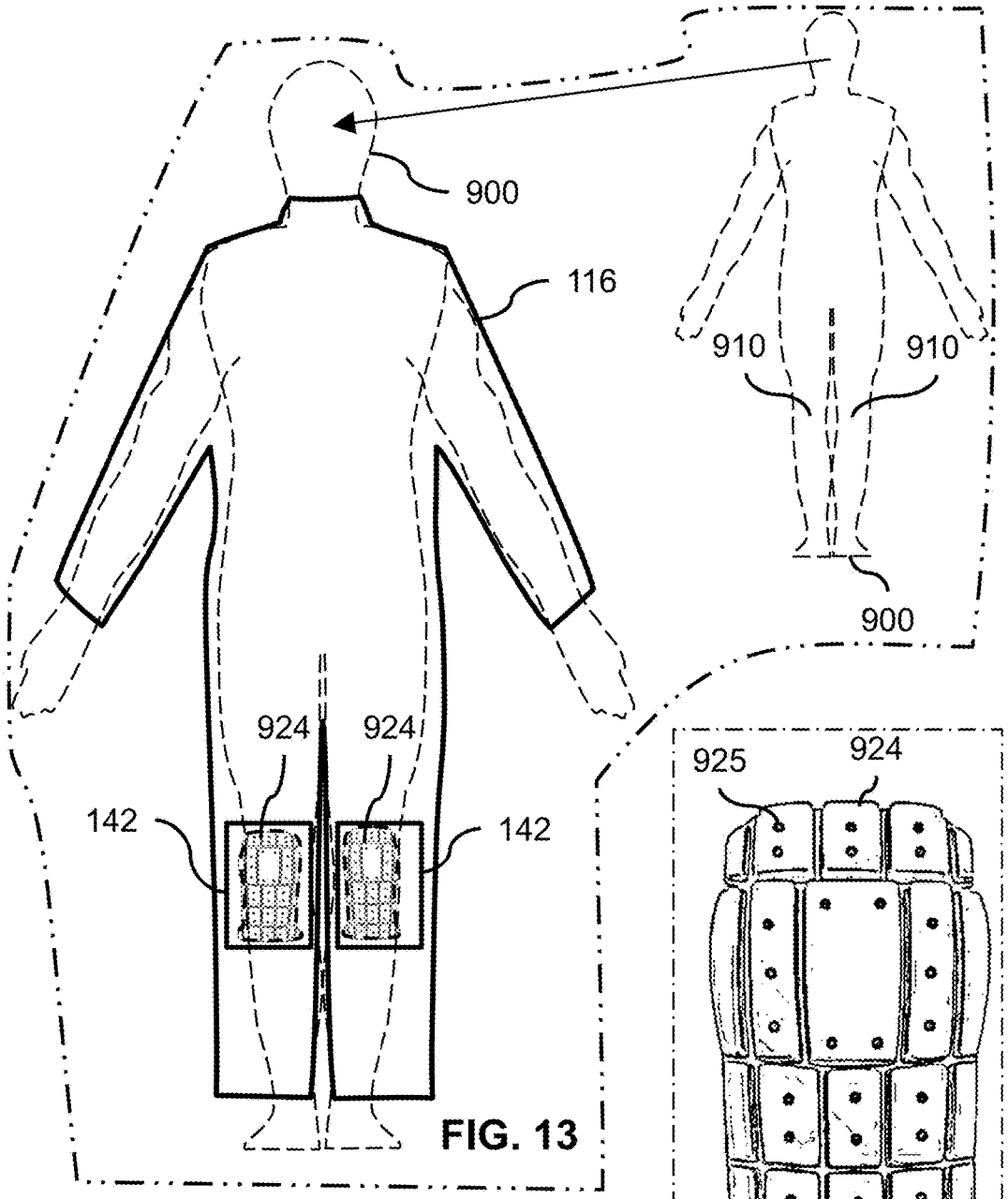
FIGS. 13 to 20 depict front views (FIGS. 13, 14, 16 and 19), a rear view (FIGS. 15 and 17), and a side view (FIG. 20) of embodiments of an apparatus including a coverall garment having knee compartments, elbow compartments, and a tailbone compartment.

In accordance with the embodiment as depicted in FIG. 13, the knee compartments 142 are configured to securely receive knee armor pads 924. This is done in such a way that the knee compartments 142 securely receive and position the knee armor pads 924 over the knees 910 of the user 900 once the coverall garment 116 is worn by the user 900. The knee armor pads 924 include a strength component. The knee armor pads 924 are removable from the knee compartments 142. The knee compartments 142 may be made of the same material as that used in the coverall garment 116 (or other suitable material). The knee compartments 142 form a pocket that has a touch connector, such as the VELCRO (TRADEMARK) connector (known and not depicted). The knee compartments 142 are configured to permit selective insertion and removal of the knee armor pads 924 relative to the interior of the knee compartments 142 (with assistance from the touch connector).

Figure 15:
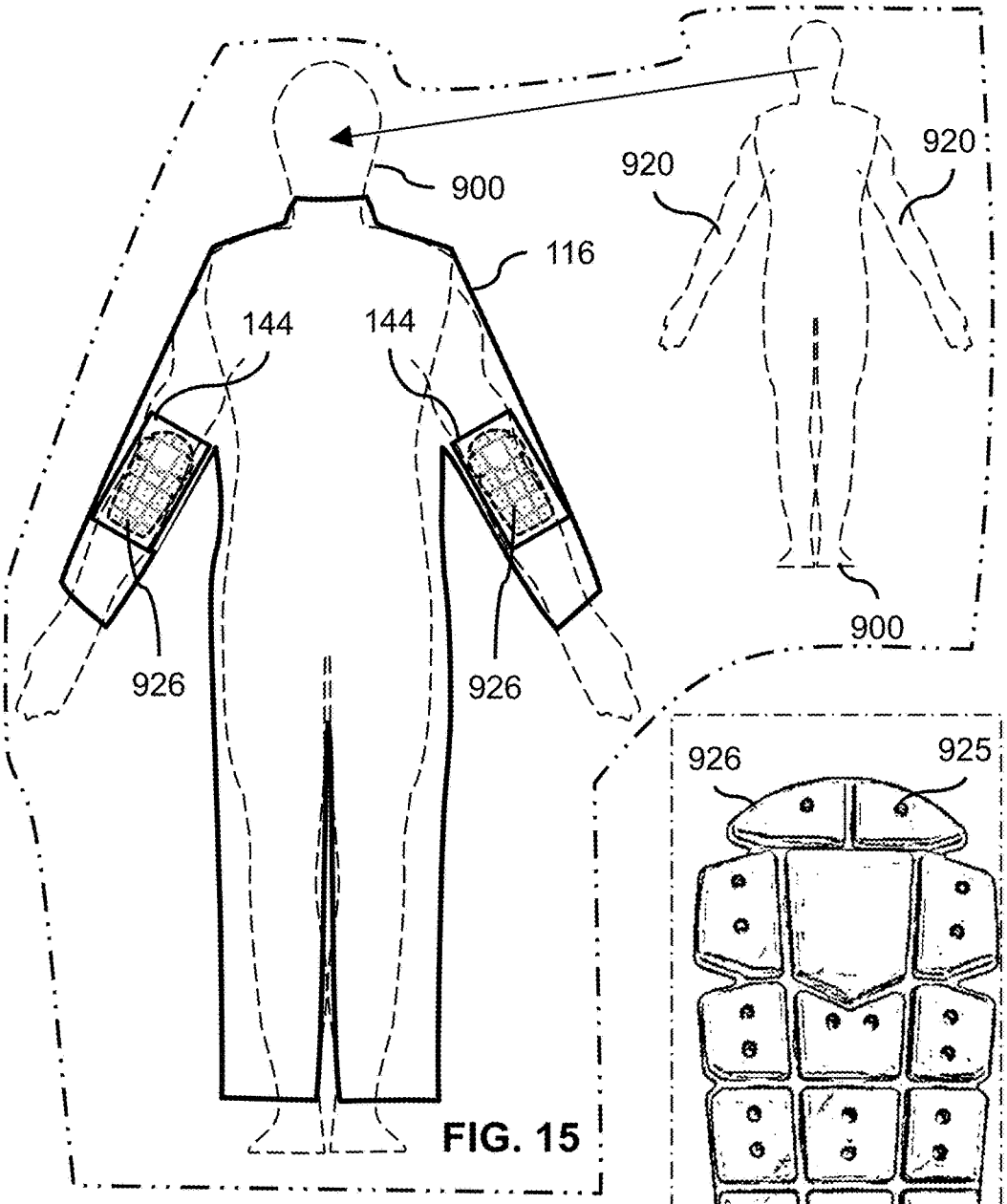

In accordance with the embodiment as depicted in FIG. 15, the elbow compartments 144 are spaced apart from the knee compartments 142. The elbow compartments 144 are configured to securely receive the elbow armor pads 926. This is done in such a way that the elbow compartments 144 securely receive and position the elbow armor pads 926 over the elbows 920 of the user 900 once the coverall garment 116 is worn by the user 900. The elbow armor pads 926 include a strength component. The elbow armor pads 926 are removable from the elbow compartments 144. The elbow compartments 144 may be made of the same material as that used in the coverall garment 116 (or other suitable material). The elbow compartments 144 form a pocket that has a touch connector, such as the VELCRO (TRADEMARK) connector (known and not depicted). The elbow compartments 144 are configured to permit selective insertion and removal of the elbow armor pads 926 relative to the interior of the elbow compartments 144 (with assistance from the touch connector).

Figures 17, 18:
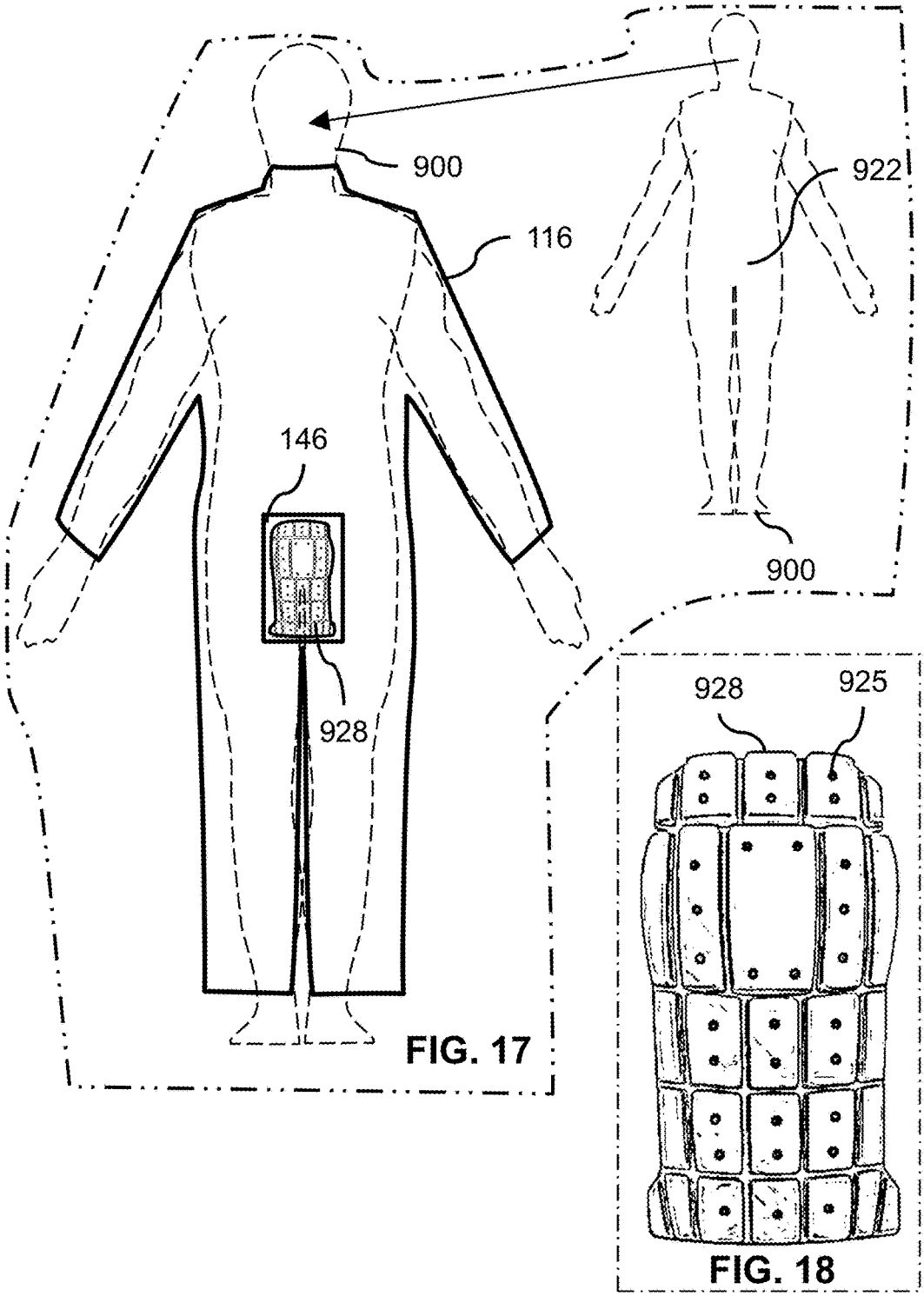

In accordance with the embodiment as depicted in FIG. 17, the tailbone compartment 146 is spaced apart from the elbow compartments 144 and the knee compartments 142. The tailbone compartment 146 is configured to securely receive a tailbone armor pad 928 in such a way that the tailbone compartment 146 securely receives and positions the tailbone armor pad 928 over the tailbone 922 of the user 900 once the coverall garment 116 is worn by the user 900. The tailbone armor pad 928 includes a strength component. The tailbone armor pad 928 is removable from the tailbone compartment 146. The tailbone compartment 146 may be made of the same material as that used in the coverall garment 116 (or other suitable material). The tailbone compartment 146 forms a pocket that has a touch connector, such as the VELCRO (TRADEMARK) connector (known and not depicted). The tailbone compartment 146 is configured to permit selective insertion and removal of the tailbone armor pad 928 relative to the interior of the tailbone compartment 146 (with assistance from the touch connector).

Figure 14:
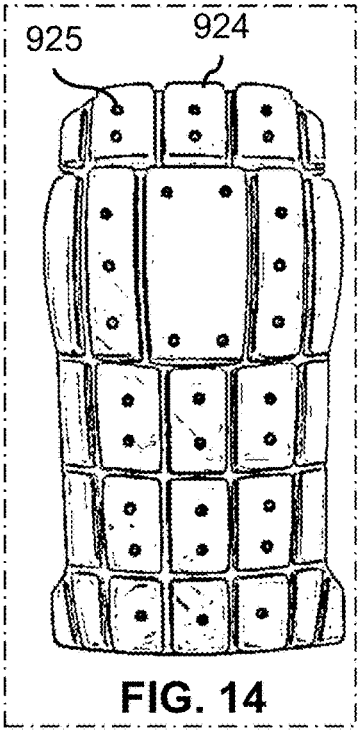

In accordance with the embodiment as depicted in FIG. 14, the knee armor pads 924 have dimensions of about 12.5 inches by about 6.5 inches and are about ⅞ths (0.875) of an inch thick. It was identified that for the case where the knee armor pads 924 were any longer or any shorter, the knee armor pads 924 would function less efficiently (once inserted into the knee compartments 142).

Figure 16:
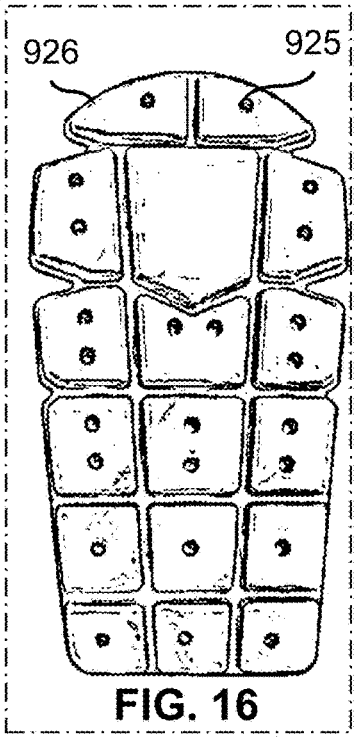

In accordance with the embodiment as depicted in FIG. 16, the elbow armor pads 926 have dimensions of about 10.5 inches by about 5.5 inches by about ⅝ths of an inch thick. It was identified that for the case where the elbow armor pads 926 were any longer or any shorter, the elbow armor pads 926 would function less efficiently (once inserted into the elbow compartments 144).

In accordance with the embodiment as depicted in FIG. 18, the tailbone armor pad 928 has dimensions of about 12.5 inches by about 6.5 inches and about ⅞ths (0.875) of an inch thick. It was identified that for the case where the tailbone armor pad 928 was any longer or any shorter, the tailbone armor pad 928 would function less efficiently (once inserted into the tailbone compartment 146).

In accordance with an embodiment as depicted in FIGS. 14, 16 and 18, the knee armor pads 924, the elbow armor pads 926, and the tailbone armor pad 928 are ventilated (with vent holes 925) for improved cooling, and user comfort, of the user. Any one of the knee armor pads 924, the elbow armor pads 926, and the tailbone armor pad 928 defines ventilation holes or ventilation channels that extends from the back side to the front side (of the armor pads).

In accordance with an embodiment, the knee armor pads 924, the elbow armor pads 926, and the tailbone armor pad 928 each include a fire retardant for improved safety of the user. The fire retardant is known and therefore not fully disclosed.

In accordance with an embodiment as depicted in FIGS. 14, 16 and 18, the knee armor pads 924, the elbow armor pads 926, and the tailbone armor pad 928 are configured (oversized) to keep the knees, the elbows and/or the tailbone of the user fully covered once the coverall garment 116 is worn by the user.

In accordance with an embodiment as depicted in FIGS. 14, 16 and 18, the knee armor pads 924, the elbow armor pads 926, and the tailbone armor pad 928 are creased horizontally and vertically for improving the flexibility of the armor pad, thereby improving flexible user movement while the user wears the coverall garment 116.

In accordance with an embodiment as depicted in FIGS. 14, 16 and 18, the knee armor pads 924, the elbow armor pads 926, and the tailbone armor pad 928 have a beveled edge (preferably, a peripheral beveled edge) for facilitating pad placement (in a respective pad compartment) for improved user comfort.

Figure 19:
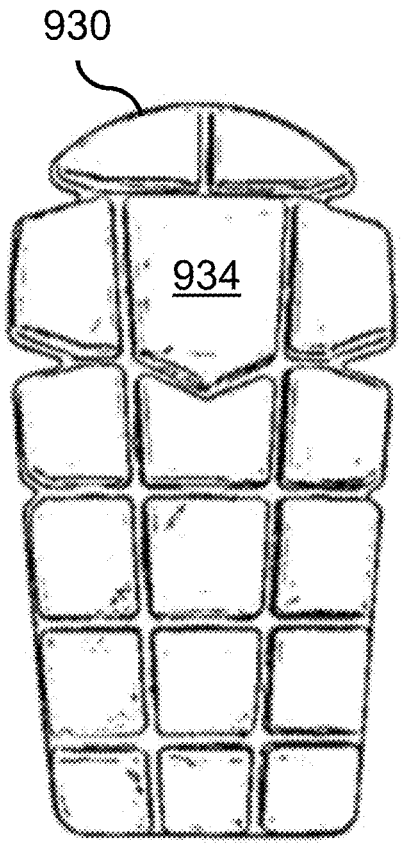
Figure 20:
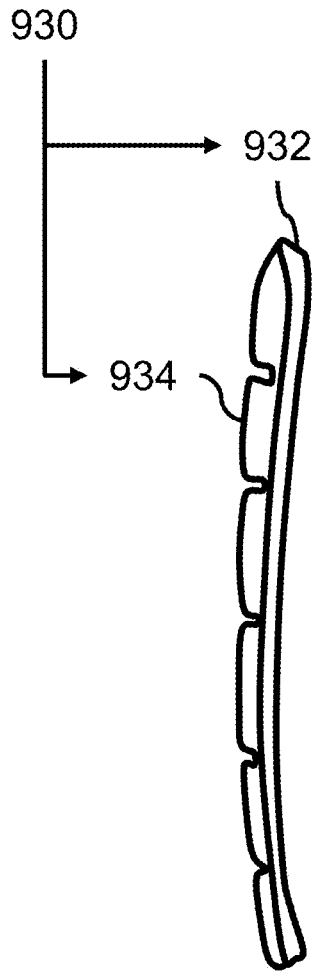

In accordance with the embodiments as depicted in FIG. 19 (showing a front view) and FIG. 20 (showing a side view), there is provided a cooling armour pad 930. The cooling armour pad 930 may have the same dimensional parameters as the knee armor pads 924 (depicted in FIG. 14) and the elbow armor pads 926 (depicted in FIG. 16), etc. The cooling armour pad 930 includes a base section 932 with a cooling portion 934 mounted to the base section 932. The cooling portion 934 includes a gel material that may be frozen (by placing the cooling portion 934 into a freezer). The base section 932 is affixed to the cooling portion 934.

The base section 932 and the cooling portion 934 each includes a fire retardant foam insulation. The cooling armour pad 930 is configured to be inserted into or received by any one of the knee compartments 142 (depicted in FIG. 13), the elbow compartments 144 (depicted in FIG. 15) and/or the tailbone compartment 146 depicted in FIG. 17.

Unless otherwise specified, relational terms used in these specifications should be construed to include certain tolerances that the person skilled in the art would recognize as providing equivalent functionality. By way of example the term perpendicular is not necessarily limited to 90.0 degrees, but also to any slight variation thereof that the person skilled in the art would recognize as providing equivalent functionality for the purposes described for the relevant member or element. Terms such as "about" and "substantially", in the context of configuration, relate generally to disposition, location, or configuration that is either exact or sufficiently close to the location, disposition, or configuration of the relevant element to preserve operability of the element within the invention which does not materially modify the invention. Similarly, unless specifically or made clear from its context, numerical values should be construed to include certain tolerances that the person skilled in the art would recognize as having negligible importance as it does not materially change the operability of the invention. It will be appreciated that the description and/or drawings identify and describe embodiments of the apparatus (either explicitly or non-explicitly). The apparatus may include any suitable combination and/or permutation of the technical features as identified in the detailed description, as may be required and/or desired to suit a particular technical purpose and/or technical function. It will be appreciated, that where possible and suitable, any one or more of the technical features of the apparatus may be combined with any other one or more of the technical features of the apparatus (in any combination and/or permutation). It will be appreciated that persons skilled in the art would know that technical features of each embodiment may be deployed (where possible) in other embodiments even if not expressly stated as such above. It will be appreciated that persons skilled in the art would know that other options would be possible for the configuration of the components of the apparatus to adjust to manufacturing requirements and still remain within the scope as described in at least one or more of the claims. This written description provides embodiments, including the best mode, and also enables the person skilled in the art to make and use the embodiments. The patentable scope may be defined by the claims. The written description and/or drawings may help to understand the scope of the claims. It is believed that all the crucial aspects of the disclosed subject matter have been provided in this document. It is understood, for this document, that the phrase "includes" is equivalent to the word "comprising." The foregoing has outlined the non-limiting embodiments (examples). The description is made for particular non-limiting embodiments (examples). It is understood that the non-limiting embodiments are merely illustrative as examples.

What is claimed is:

1. An apparatus, comprising:

a coverall garment having a waist section, and being configured to be worn by a range of users, in which each user of the range of users respectively has a waist region defining a corresponding respective circumferential waist size that is different from user to user; and first spaced-apart belt loops being circumferentially positioned and affixed to, and circumferentially aligned along, the waist section of the coverall garment; and the first spaced-apart belt loops being spaced apart from and end section of leg sections of the coverall garment, in which a first fixed distance extends, and is maintained, between the first spaced-apart belt loops and the end section of the leg sections of the coverall garment once the coverall garment is worn; and the first spaced-apart belt loops being configured to selectively receive a belt for a first user which has a first user vertical height that ranges within a first user vertical height range in such a way that the first spaced-apart belt loops, in use, improve, at least in part, fit of the coverall garment to the first user once the first spaced-apart belt loops, in use, selectively receive the belt, and once the coverall garment is worn by the first user; and second spaced-apart belt loops being positioned relative to the first spaced-apart belt loops; and the second spaced-apart belt loops being circumferentially positioned and affixed to, and circumferentially aligned along, the waist section of the coverall garment; and the second spaced-apart belt loops being spaced apart from the end section of the leg sections of the coverall garment, in which a second fixed distance extends, and is maintained, between the second spaced-apart belt loops and the end section of the leg sections of the coverall garment once the coverall garment is worn; and the second spaced-apart belt loops being configured to selectively receive the belt for a second user which has a second user vertical height that ranges within a second user vertical height range in such a way that the second spaced-apart belt loops, in use, improve, at least in part, the fit of the coverall garment to the second user once the second spaced-apart belt loops, in use, selectively receive the belt, and once the coverall garment is worn by the second user; and the second spaced-apart belt loops being circumferentially fixedly aligned with, and spaced apart from, the first spaced-apart belt loops; and the first spaced-apart belt loops and the second spaced-apart belt loops being maintained at respective fixed unmovable positions inside the coverall garment, stacked one over the other; and the first spaced-apart belt loops and the second spaced-apart belt loops remaining unmovable relative to each other, and fixedly positioned inside the coverall garment once the garment is worn; and the coverall garment having a non-collapsible fixed length extending from the shoulder section of the coverall garment to the end section of the leg sections of the coverall garment.

2. The apparatus of claim 1, further comprising:

third spaced-apart belt loops being positioned relative to the second spaced-apart belt loops and the first spaced-apart belt loops; and the third spaced-apart belt loops being circumferentially positioned and affixed to, and circumferentially aligned along, the waist section of the coverall garment; and the third spaced-apart belt loops being spaced apart from the end section of the leg sections of the coverall garment, in which a third fixed distance extends, and is maintained, between the third spaced-apart belt loops and the end section of the leg sections of the coverall garment once the coverall garment is worn; and the third spaced-apart belt loops being configured to selectively receive the belt for a third user which has a third vertical height that ranges within a third vertical height range in such a way that the third spaced-apart belt loops, in use, improve, at least in part, the fit of the coverall garment to the third user once the third spaced-apart belt loops, in use, selectively receive the belt, and once the coverall garment is worn by the third user; and the third spaced-apart belt loops being circumferentially fixedly aligned with, and spaced apart from, the first spaced-apart belt loops; and the third spaced-apart belt loops being circumferentially fixedly aligned with, and spaced apart from, the second spaced-apart belt loops; and the third spaced-apart belt loops, the second spaced-apart belt loops and the first spaced-apart belt loops being maintained at respective fixed unmovable positions inside the coverall garment, stacked one over the other; and the third spaced-apart belt loops, the second spaced-apart belt loops and the first spaced-apart belt loops remaining unmovable relative to each other and fixedly positioned inside the coverall garment.

3. The apparatus of claim 2, further comprising:

an interior waist section being positioned inside the coverall garment; and the interior waist section being configured to be positioned proximate to the waist region of a user once the coverall garment is worn; and wherein:

the first spaced-apart belt loops are circumferentially affixed to the interior waist section of the coverall garment; and the second spaced-apart belt loops are circumferentially affixed to the interior waist section of the coverall garment; and the third spaced-apart belt loops are circumferentially affixed to the interior waist section of the coverall garment.

4. The apparatus of claim 2, further comprising:

an interior garment surface being positioned inside the coverall garment; and the interior garment surface including an interior waist section being configured to be positioned proximate to the waist region of a user once the coverall garment is worn; and wherein:

the first spaced-apart belt loops are circumferentially affixed to the interior waist section of the interior garment surface of the coverall garment; and the second spaced-apart belt loops are circumferentially affixed to the interior waist section of the interior garment surface of the coverall garment; and the third spaced-apart belt loops are circumferentially affixed to the interior waist section of the interior garment surface of the coverall garment.

5. An apparatus, comprising:

a coverall garment being configured to be worn by a user having knees, elbows and a tailbone; and the coverall garment, including:

knee compartments being configured to securely receive knee armor pads in such a way that the knee compartments securely receive and position the knee armor pads over the knees of the user once the coverall garment is worn by the user; and elbow compartments being spaced apart from the knee compartments; and the elbow compartments being configured to securely receive elbow armor pads in such a way that the elbow compartments securely receive and position the elbow armor pads over the elbows of the user once the coverall garment is worn by the user; and a tailbone compartment being spaced apart from the elbow compartments and the knee compartments; and the tailbone compartment being configured to securely receive a tailbone armor pad in such a way that the tailbone compartment securely receives and positions the tailbone armor pad over the tailbone of the user once the coverall garment is worn by the user; and the coverall garment having a waist section, and being configured to be worn by a range of users, in which each user of the range of users respectively has a waist region defining a corresponding respective circumferential waist size that is different from user to user; and the coverall garment further including:

first spaced-apart belt loops being circumferentially positioned and affixed to, and circumferentially aligned along, the waist section of the coverall garment; and the first spaced-apart belt loops being spaced apart from the end section of the leg sections of the coverall garment, in which a first fixed distance extends, and is maintained, between the first spaced-apart belt loops and the end section of the leg sections of the coverall garment once the coverall garment is worn; and the first spaced-apart belt loops being configured to selectively receive a belt for a first user which has a first user vertical height that ranges within a first user vertical height range in such a way that the first spaced-apart belt loops, in use, improve, at least in part, fit of the coverall garment to the first user once the first spaced-apart belt loops, in use, selectively receive the belt, and once the coverall garment is worn by the first user; and second spaced-apart belt loops being positioned relative to the first spaced-apart belt loops; and the second spaced-apart belt loops being circumferentially positioned and affixed to, and circumferentially aligned along, the waist section of the coverall garment; and the second spaced-apart belt loops being spaced apart from the end section of the leg sections of the coverall garment, in which a second fixed distance extends, and is maintained, between the second spaced-apart belt loops and the end section of the leg sections of the coverall garment once the coverall garment is worn; and the second spaced-apart belt loops being configured to selectively receive the belt for a second user which has a second user vertical height that ranges within a second user vertical height range in such a way that the second spaced-apart belt loops, in use, improve, at least in part, the fit of the coverall garment to the second user once the second spaced-apart belt loops, in use, selectively receive the belt, and once the coverall garment is worn by the second user; and the second spaced-apart belt loops being circumferentially fixedly aligned with, and spaced apart from, the first spaced-apart belt loops; and the first spaced-apart belt loops and the second spaced-apart belt loops being maintained at respective fixed unmovable positions inside the coverall garment, stacked one over the other; and the first spaced-apart belt loops and the second spaced-apart belt loops remaining unmovable relative to each other, and fixedly positioned inside the coverall garment once the garment is worn; and the coverall garment having a non-collapsible fixed length extending from the shoulder section of the coverall garment to the end section of the leg sections of the coverall garment.

6. The apparatus of claim 5, wherein:

the knee armor pads have dimensions of about 12.5 inches by about 6.5 inches and are about ⅞ths of an inch thick.

7. The apparatus of claim 5, wherein:

the elbow armor pads have dimensions of about 10.5 inches by about 5.5 inches and are about ⅝ths of an inch thick.

8. The apparatus of claim 5, wherein:

the tailbone armor pad has dimensions of about 12.5 inches by about 6.5 inches and is about ⅞ths of an inch thick.

9. The apparatus of claim 5, wherein:

the knee armor pads, the elbow armor pads, and the tailbone armor pad are ventilated for improved cooling and comfort of the user.

10. The apparatus of claim 5, wherein:

the knee armor pads, the elbow armor pads, and the tailbone armor pad each include a fire retardant for improved safety of the user.

11. The apparatus of claim 5, wherein:

the knee armor pads, the elbow armor pads, and the tailbone armor pad are configured to keep the knees, the elbows and the tailbone of the user fully covered.

12. The apparatus of claim 5, wherein:

the knee armor pads, the elbow armor pads, and the tailbone armor pad are creased horizontally and vertically for improving movement of the user while the user wears the coverall garment.

13. The apparatus of claim 5, wherein:

the knee armor pads, the elbow armor pads, and the tailbone armor pad have a beveled edge for facilitating pad placement for improved comfort of the user.

14. The apparatus of claim 5, wherein:

a cooling armour pad is configured to be inserted into and received by any one of the knee compartments, the elbow compartments, and the tailbone compartment.

15. The apparatus of claim 5, wherein:

the coverall garment further includes:

third spaced-apart belt loops being positioned relative to the second spaced-apart belt loops and the first spaced-apart belt loops; and the third spaced-apart belt loops being circumferentially positioned and affixed to, and circumferentially aligned along, the waist section of the coverall garment; and the third spaced-apart belt loops being spaced apart from the end section of the leg sections of the coverall garment, in which a third fixed distance extends, and is maintained, between the third spaced-apart belt loops and the end section of the leg sections of the coverall garment once the coverall garment is worn; and the third spaced-apart belt loops being configured to selectively receive the belt for a third user which has a third vertical height that ranges within a third vertical height range in such a way that the third spaced-apart belt loops, in use, improve, at least in part, the fit of the coverall garment to the third user once the third spaced-apart belt loops, in use, selectively receive the belt, and once the coverall garment is worn by the third user; and the third spaced-apart belt loops being circumferentially fixedly aligned with, and spaced apart from, the first spaced-apart belt loops; and the third spaced-apart belt loops being circumferentially fixedly aligned with, and spaced apart from, the second spaced-apart belt loops; and the third spaced-apart belt loops, the second spaced-apart belt loops and the first spaced-apart belt loops being maintained at respective fixed unmovable positions inside the coverall garment, stacked one over the other; and the third spaced-apart belt loops, the second spaced-apart belt loops and the first spaced-apart belt loops remaining unmovable inside the coverall garment; and the coverall garment having a fixed length extending from the shoulder section of the coverall garment to the end section of the leg sections of the coverall garment.

16. The apparatus of claim 5, wherein:

the tailbone compartment is for securely receiving, and positioning, a cooling armour pad adjacent to the tailbone of the user once:

the cooling armour pad is inserted into, and is received by, the tailbone compartment, and the coverall garment is worn; and the cooling armour pad includes a gel material that is freezable; and the belt maintains the gel material of the cooling armour pad, which is received by the tailbone compartment, in a close relationship with the tailbone of the user once:

the belt is inserted in at least one of the first spaced-apart belt loops and the second spaced-apart belt loops, and the coverall garment is worn, and the belt is positioned over the gel material of the cooling armour pad, and the belt is tightened; and the belt improves the thermal exchange between the gel material of the cooling armour pad and the tailbone of the user once:

the gel material is frozen, and the belt maintains the gel material of the cooling armour pad in the close relationship with the tailbone of the user.

17. The apparatus of claim 16, wherein:

the coverall garment further includes:

third spaced-apart belt loops being positioned relative to the second spaced-apart belt loops and the first spaced-apart belt loops; and the third spaced-apart belt loops being circumferentially positioned and affixed to, and circumferentially aligned along, the waist section of the coverall garment; and the third spaced-apart belt loops being spaced apart from the end section of the leg sections of the coverall garment, in which a third fixed distance extends, and is maintained, between the third spaced-apart belt loops and the end section of the leg sections of the coverall garment once the coverall garment is worn; and the third spaced-apart belt loops being configured to selectively receive the belt for a third user which has a third vertical height that ranges within a third vertical height range in such a way that the third spaced-apart belt loops, in use, improve, at least in part, the fit of the coverall garment to the third user once the third spaced-apart belt loops, in use, selectively receive the belt, and once the coverall garment is worn by the third user; and the third spaced-apart belt loops being circumferentially fixedly aligned with, and spaced apart from, the first spaced-apart belt loops; and the third spaced-apart belt loops being circumferentially fixedly aligned with, and spaced apart from, the second spaced-apart belt loops; and the third spaced-apart belt loops, the second spaced-apart belt loops and the first spaced-apart belt loops being maintained at respective fixed unmovable positions inside the coverall garment, stacked one over the other; and the third spaced-apart belt loops, the second spaced-apart belt loops and the first spaced-apart belt loops remaining unmovable inside the coverall garment; and the coverall garment having a fixed length extending from the shoulder section of the coverall garment to the end section of the leg sections of the coverall garment.

* * * * *